United States Patent [19]

Winch et al.

[11] 4,219,908

[45] * Sep. 2, 1980

[54] PROCESS AND APPARATUS FOR TREATING FIBROUS MATERIALS FOR SUBSEQUENT PROCESSING

[75] Inventors: Allen R. Winch, Westfield, N.J.; Charles H. Chewning, Jr., Durham, N.C.

[73] Assignee: Cotton, Incorporated, New York, N.Y.

[ * ] Notice: The portion of the term of this patent subsequent to Dec. 28, 1995, has been disclaimed.

[21] Appl. No.: 905,964

[22] Filed: May 15, 1978

Related U.S. Application Data

[63] Continuation-in-part of Ser. No. 698,502, Jun. 22, 1976, Pat. No. 4,126,914.

[51] Int. Cl.[2] ..... D01G 15/26

[52] U.S. Cl. ..... 19/99; 19/104; 19/107

[58] Field of Search ..... 19/84, 88, 89, 98–101, 19/105, 106 R, 107, 104

[56] References Cited

U.S. PATENT DOCUMENTS

| | | | |
|---|---|---|---|
| 2,181,535 | 11/1939 | Schlipp et al. | 19/99 |
| 3,512,217 | 5/1970 | Bettoni | 19/107 X |
| 4,126,914 | 11/1978 | Winch et al. | 19/99 |

FOREIGN PATENT DOCUMENTS

| | | | |
|---|---|---|---|
| 821074 | 11/1937 | France | 19/105 |
| 45-18051 | 6/1970 | Japan | 19/107 |
| 166264 | 4/1965 | U.S.S.R. | 19/99 |

*Primary Examiner*—Louis Rimrodt

*Attorney, Agent, or Firm*—Burns, Doane, Swecker & Mathis

[57] ABSTRACT

Processes and apparatus for treating fibrous materials for subsequent processing are described. Such processes and apparatus are able to provide a continuously high throughput, e.g., 400 pounds per hour or more, while achieving an acceptable degree of cleanliness and uniformity with a substantial absence of formation of neps. In a preferred embodiment, the fiber treatment unit includes a train of rolls adjacently mounted for rotation about parallel axes. Adjacent rolls rotate in opposite directions and each is provided with a plurality of fiber grabbing, card clothing teeth. A number of additional carding points about the rotating cylinders are provided. Numerous trash removing assemblies adjacent the rotating rolls provide for removal of trash and other dry particles, thus preventing escape of such particles into the atmosphere and minimizing health hazards at this and subsequent fiber process stages. In order to achieve the stated objective of high capacity, the several rolls are rotated typically at excessively higher than conventional card peripheral velocities.

Fiber may be fed to the apparatus of the present invention either by a single feed roll/feed plate arrangement, or by a plurality of feed roll/feed plate arrangements. Various air suction devices may be arranged throughout the apparatus to assist in particulate matter removal. In some situations, particulate matter removal may be undesirable during specific portions of the process and such removal is therefore prevented by a selective placement of solid shrouding members.

23 Claims, 8 Drawing Figures

PROCESS AND APPARATUS FOR TREATING FIBROUS MATERIALS FOR SUBSEQUENT PROCESSING

BACKGROUND OF THE INVENTION

This application is a continuation-in-part of our copending patent application, Ser. No. 698,502, which was filed on June 22, 1976, now U.S. Pat. No. 4,126,914.

This invention relates to treating fibrous material for subsequent processing. The invention also relates to cleaning, fine opening and orienting of fibrous materials in the production of a web thereof. More particularly, it relates to cleaning and orienting of fibrous materials in the high capacity production of a web. Still more particularly, it relates to an apparatus and method applicable to cotton, synthetic fibers, cotton blends, wool, and other textile fibers.

In the past, the production of nonwoven cotton batts, for example for subsequent production of nonwoven fabrics of sliver, has commonly entailed a process wherein the material supplied to an ordinary nonwoven finisher carding machine has undergone scouring and bleaching (hereinafter referred to as "chemical treatment") by means of a batch-kier technique. The product of this chemical treatment constitutes a wet cake of fiber that must be broken up to dry. Wet picking practices undertaken in this connection often form non-uniform, stringy and twisted elements which, in turn, result in a non-uniform web emanating from the carding machine and having varying amounts of neps.

This natural result of the conventional chemical treatment can be avoided by providing a continuous scouring and bleaching operation for preparation of the material to be supplied to the finishing cards. Such a continuous scouring and bleaching operation would allow for treatment and drying of a web on a continuous basis, thereby avoiding the wetpicking procedures which form the stringy, twisted elements.

In order to render a continuous chemical treatment operation economically feasible, however, it is necessary that the web be supplied to the scouring and bleaching equipment at a relatively high rate, such as several hundred pounds of material per hour, e.g., about four hundred pounds per hour or more. It is also desirable that the web so supplied be reasonably clean, of appropriate area density, uniformly constituted and free of neps to an acceptable degree.

It is known that conventional carding machines are capable of producing a greige cotton web of relatively low weights per yard, or low area densities. Since the extent of cleaning and opening is, to a great degree, a function of web weight, the greater the degree of attenuation of the web, the cleaner it will be. However, when conventional carding machines are operated to pre-open and to pre-clean fiber to the desired degree for subsequent carding to produce card sliver for spinning or for continuous scouring and bleaching, production capacity is significantly sacrificed. Indeed, production capacity of seventy pounds per hour is considered high for conventional 42 inch wide carding machines; it is generally, on the average, considerably lower. Experimental runs at up to three hundred pounds per hour capacity have been conducted with conventional carding machines, but web uniformity and cleanliness were detrimentally affected to the point of producing a commercially unacceptable product.

The unfeasibility of using the common carding apparatus for high capacity production of acceptably opened and cleaned fiber stems from the inherent structural characteristics of the common carding apparatus.

Conventional carding machines, as they have been in use for many years, and as are still predominantly in use, consist essentially of a lickerin to pluck small tufts of fiber from a batt of partially opened fibers, a carding cylinder onto which the fibers are deposited by the lickerin, a plurality of flat bars, the "revolving flats", which surround about one-third of the peripheral surface of the carding cylinder, and a doffer which removes the fibers from the cylinder. The revolving flats have a needle or wire clothing surface, similar to that of the carding cylinder. The flats, which are relatively motionless with respect to the cylinder, move only a few inches per minute for the purpose of being cleaned. The carding cylinder, which, in the conventional card is ordinarily about 50 inches in diameter, rotates at a peripheral speed of about 2000 to 4000 feet per minute as it carries the fibers past the revolving flats.

During the card process, the needles of the revolving flats collect fibers from the carding cylinder and become loaded and relatively ineffective for about 60 percent of the working cycle. The unopened fibers collected by the flats amount to about from two to five percent of the total fibrous material fed to the machine. These fibers, known as "flat strips", are generally disposed of as waste. In addition, loading of the flats also forces the fibers on the cylinder down into the cylinder clothing, causing impacting, and increasing the amount of material wasted by about another one percent. It is thus seen that a number of factors combine to contribute to the limitation on the output capacity of the conventional carding apparatus. A problem which in recent years, has achieved prominence is that the structure and accompanying mechanism of the revolving flats are such that it is generally difficult to provide adequate cover for the entire machine to avoid contaminating the atmosphere in the vicinity of the machines with flying dust and fibers. As already mentioned, in the case of the conventional carding apparatus, the main carding cylinder itself generally rotates at a peripheral speed of about 2000 to 4000 feet per minute as it carries the fibers past the revolving flats. At this speed the output of the card may vary from about 10 to about 50 or 60 pounds of carded cotton per hour.

From the foregoing, it will be apparent that utilization of conventional carding machines to continuously supply fiber for continuous chemical treatment, as discussed above, has not been entirely feasible. On the one hand, if a high mass rate of feed for continuous chemical treatment were desired by a mill, there would be a need for a large capital investment in a great number of carding machines to operate simultaneously to yield the required fiber supply. On the other hand, if fewer machines were operated, this would require settling for a low supply rate. Such a sacrifice of input capacity to the chemical treatment operation would dominate the entire run thereafter, thus rendering the economics of continuous scouring and bleaching marginal at best. If a middle ground were to be chosen so that an intermediate number of conventional machines were simultaneously operated at higher than normal production rates, batt or web uniformity and cleanliness would be sacrificed, while only partially reducing the large capital investment in carding machines.

It is, therefore, desirable to provide a novel apparatus and process, particularly applicable to cotton, but not limited thereto, whereby fiber can be reasonably well pre-opened and mechanically pre-cleaned at high capacity, e.g., up to about 700 pounds per hour or higher on a 42 inch card width basis.

Attempts have been made over the years to improve various aspects of the carding operation. However, these attempts appear to have been restricted to solving isolated difficulties rather than to producing a comprehensively new carding apparatus which solved a broad spectrum of difficulties, such as fiber damage, nonuniformity of the carded web, environmental contamination, low output, and the like.

One proposed device, stated to improve the quality of the carded fibers were disclosed in 1935 in U.S. Pat. No. 2,014,673. This device essentially comprised two cylinders mounted adjacent one another for rotation on parallel axes. The first cylinder, to which fibers to be carded, cleaned, or opened were fed, was provided with peripheral teeth tangent to the surface of the cylinder. Teeth of this design were stated to separate and align the fibers without damaging them. The fibers were removed from the teeth of the first cylinder by projecting teeth mounted on the periphery of the second cylinder. Instead of revolving flats, the cylinders were provided with tightly fitting cylindrical covers on the upper portions of their peripheries and with grid bars below for removing trash and other foreign matter. The fibers were removed from the second cylinder by means of a current of air. It is interesting to note further that this disclosure shows a stripping action where the rake angles shown on the teeth of the "feed" roll and the "stripping" roll are such that the stripping roll must either rotate more slowly and in an opposite direction to the feed roll, or the stripping roll must rotate in the same direction as the feed roll, in order to strip the fiber from the feed roll. It should also be noted that U.S. Pat. No. 2,041,673 stipulates that the teeth of the stripping roll sweep through the channels of the teeth in the feed roll.

Another proposal for eliminating the revolving flats and to improve the quality of the carded fibers was disclosed in U.S. Pat. No. 2,879,549. This proposal comprised substituting a tightly-fitted cover plate over the carding cylinder and coating the concave inside surface of this cover plate with a granular, abrasive material. The mass of fibers, as it was carried around by the carding cylinder, was subjected to the abrasive and retarding action of the granular surface which caused the fibers to be straightened and attenuated. Although this device was stated to produce a batt or sliver with less waste and containing fewer naps, as well as minimizing the delivery to the surrounding atmosphere of dust and other fibers, it nevertheless was still basically dependent on a conventional carding cylinder, operating at its usual peripheral speed of about 2000 to 4000 feet per minute. Although this device was also stated to result in a higher output of a better quality fiber, this increase in output actually represented a minimization of waste within the machine itself rather than the result of a higher throughout capacity. In other words, the increased output was a result of the substantial elimination of the "flat strips" which constituted unopened fibers collected by the conventional revolving flats, as well as the waste resulting from loading of the cylinder clothing itself. The reduction in neps was the result of further minimizing the loading of the teeth on the revolving cylinder itself.

An improvement over the granular card was disclosed in U.S. Pat. No. 3,604,062 which, in one aspect, substituted a concave plate having a plurality of teeth on its inside concave surface, for the abrasive-coated plate of U.S. Pat. No. 2,879,549. The carding cylinder itself was provided with teeth having a forward rake angle, while the teeth on the inner surface of the stationary concave cover were pitched in the opposite direction. In the conventional revolving flat type of cards, as well as those having roller tops, the teeth on the flats or rolls do not present a continuous opposing carding surface to the teeth on the main cylinder. Therefore, in the cases of revolving flat or roller type cards, the carding action is accomplished only at intermittent tangent lines along the moving cylindrical surface. As regards the granular type card, the stationary surface is made up of granules which are irregular in shape, have little depth, and are of a relatively smooth surface, all of which combine to result in a general diminishing of carding uniformity and efficiency. In the carding apparatus of U.S. Pat. No. 3,604,062, carding takes place in a uniform manner over the entire surface with the result that more actual carding points are provided. Another advantage claimed for the machine of U.S. Pat. No. 3,604,062 was that it also could be used in conjunction with the conventional revolving flat type cards, or with roller type cards, where the fibers are first carded by the revolving flats or rollers covering a portion of the carrying surface of the main carding cylinder, and the final carding could be accomplished by placing a smaller stationary plate adjacent the carding surface of the main cylinder immediately following the revolving flats or worker roll. It was thus possible to further card the fibers without the necessity of transferring them to a different machine. As a result of this invention, it was possible to produce a carding machine having a main cylinder of smaller diameter than those which had been conventionally used. Another advantage claimed for the apparatus of the patent was greater durability as a result of using the metallic card clothing. A further advantage of this machine was stated to be the ability to use only a single lickerin cylinder and a single doffer. Such a machine, however, still only had a production capacity varying from 10 to 80 pounds per hour, depending on the machine adjustment. This output was not significantly different from that of the conventional card and was still not satisfactory where a high, continuous output is required for supplying a high quality batt or web directly to the chemical treating operation or the spinning process.

U.S. Pat. No. 3,081,499 disclosed apparatus comprising a train of three parallel, toothed cylinders all of equal diameter. The first two cylinders rotated in the same direction (e.g., counterclockwise) while the third rotates in the opposite direction. Each cylinder was provided with teeth which are disclosed to be substantially radial, that is, the forward faces of the teeth have substantially a zero rake angle in that they are straight, linear extensions of a radius of the cylinder. The first cylinder constituted the breaker, while carding was accomplished by the teeth in the nip between the first two cylinders. Each of the first two cylinders was provided with a smaller, clearer roll. The third cylinder provided a condensing action to densify the attenuated fibers and deliver them to a conveyor in the form of a self-sustaining web. One of the advantages asserted by the patent was the greatly increased capacity of the carding unit as regards the quantity of fiber which could be successfully passed through the machine. Thus, the patent points out, that in a conventional carding machine where the main carding cylinder has a diameter of about 50 inches and is rotated at about 165 rpm, established practice calls for a feed rate of about 10 pounds per hour of cotton. Furthermore, the conventional carding machines described in the background of U.S. Pat. No. 3,081,499, because of the loading of the flats, require continuous shutdowns over a day's operation for cleaning, with the frequency of shutdowns increasing as attempts are made to increase the speed of operation. According to the patent, on the other hand, the disclosed carding machine can be maintained at a continuous throughput rate of 60 pounds per hour of cotton.

The search has continued therefore, for processes and apparatus able to provide a continuously high throughput e.g., 400 to 700 pounds per hour or more, while achieving an acceptable degree of cleanliness and uniformity (fine opening and orientation), with a substantial absence of formation of neps.

SUMMARY OF THE INVENTION

Recognizing the foregoing, it is a general object of the present invention to provide a novel apparatus and process for finely pre-opening and pre-cleaning fiber and, if desired, to also produce a uniform mass or web of fibrous material.

It is a particular object of the present invention to provide such a novel apparatus and process capable of a high capacity production of such a mass of fiber, batt, or web.

A further object of the invention is to provide an apparatus and process which is capable of maintaining a continuous, high capacity production rate of a clean and uniform mass or web.

A further object is to provide novel processes and apparatus for opening and cleaning fibers for subsequent processing.

Another object of the present invention is to provide a novel apparatus and process capable of maintaining a continuous, high capacity production of a web of textile fibers of sufficiently high quality and uniformity to permit them to be used directly for production of spun yarns.

Yet another object of this invention relates particularly to the provision of a novel apparatus and process capable of maintaining a continuous, high capacity production of a web of carded cotton fibers of sufficiently high quality and uniformity to permit their use directly in a continuous chemical scouring and bleaching operation.

In accordance with one aspect of the present invention, a process is provided for treating a mass of tangled, randomly oriented fibers, which process comprises:

(I) conveying the gross mass of fibers in a generally longitudinal travel direction to a first location while gripping the gross mass of fibers;

(II) subjecting the gripped mass of fibers to a deflection at the first location to cause leading fiber portions of mass fractions of fibers to experience a deflecting motion generally transverse to the longitudinal travel direction and simultaneously subjecting the leading fiber portions of the mass fractions to an accelerating force in a first circular direction of travel for the fibers, the force tending to accelerate the mass fractions of fibers in the first circular travel direction, and to thereby increase the linear speed of the mass fractions of the fibers to a linear speed of above about 2,000 feet per minute, the deflecting in the transverse direction and accelerating force in the first circular travel direction while gripping the gross mass of fibers effecting plucking of the mass fractions from the gross mass of tangled, randomly oriented, fibers and assisting in thinning and orienting the mass of fibers in the travel direction and assisting in disentangling the fibers;

(III) at a second location downstream of the first location subjecting the mass fraction of fibers traveling in a circular travel direction to a generally tangential accelerating force to thereby further increase the linear speed of the mass fractions of fibers in a second circular travel direction sinuous to the upstream circular travel direction to cause the fibers to accelerate freely in the second circular travel direction while carding a first face portion of the mass fractions of fibers at the second location, the combined effects of accelerating sinuously and carding on the first face portion tending to thin and draft apart individual fibers in the travel direction and tending to separate and disentangle individual fibers laterally of the travel direction;

(IV) at a third location downstream of the second location subjecting the mass fractions of fibers traveling in a circular travel direction to another generally tangential accelerating force to thereby still further increase the linear speed of the mass fractions of fibers in a third circular travel direction sinuous to the upstream circular travel direction to cause the fibers to accelerate freely in the third circular travel direction while at the third location carding a second face portion on a mass fractions side opposite the first face portion of the mass fractions of fibers, the combined effects of accelerating sinuously and carding on the second opposite face portion tending to thin and draft apart individual fibers in the travel direction and tending to separate and disentangle individual fibers laterally of the travel direction;

(V) subjecting the mass fractions of fibers at a subsequent location downstream of the third location to a decelerating force to thereby decrease the linear speed of the mass fractions of fibers to cause consolidating of the individual fibers and condensing of the mass fractions of fibers;

(VI) subsequent to step (II) and prior to step (V), at at least one location where the mass fractions of fibers are in a circular travel direction at a constant velocity, additionally carding the mass fractions of fibers on at least one face portion to cause a retarding effect on individual fiber portions in the carded face portion while the velocity of remaining individual fiber portions is being maintained, thereby aiding in orienting and separating individual fibers in the travel direction and laterally thereof and aiding in further disentanglement of individual fibers; and (VII) subsequent to step (V), recovering a consolidated mass of fibers.

Other objects, aspects and advantages falling within the scope of the present invention will become apparent to those skilled in the art from the following description of the preferred embodiments when read in conjunction with the accompanying drawing.

DESCRIPTION OF THE PREFERRED EMBODIMENTS

Figure 1:
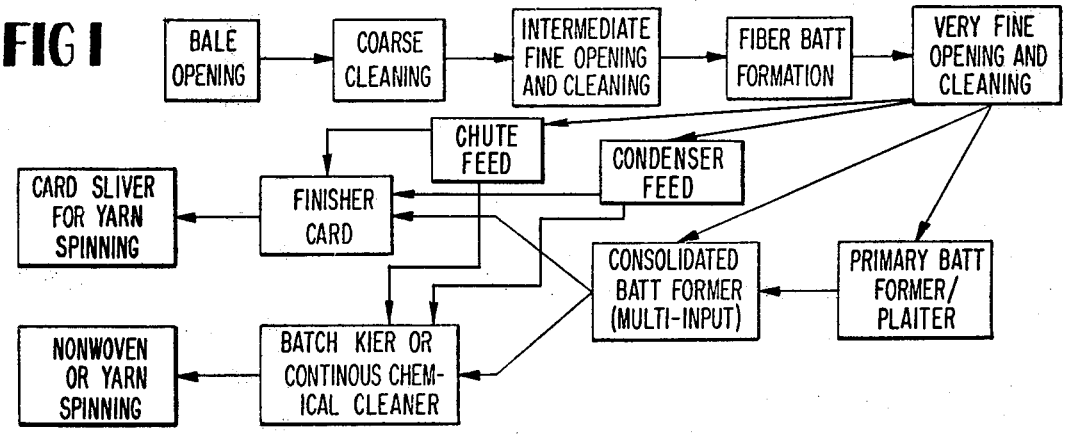
FIG. 1 is a schematic flow diagram of stages of representative cotton fiber treatment systems utilizing the processes and apparatus of the present invention to provide a very fine opening (with orientation) and cleaning.

Referring to FIG. 1, a schematic flow diagram is shown of stages of representative cotton fiber treatment systems utilizing the processes and apparatus of the present invention to provide very fine opening and cleaning. In FIG. 1, two total process systems are shown, with the initial stages from bale opening through batt forming being common to each process.

In a first system, greige cotton bales are segregated according to quality grades and/or cotton varieties or selections, with particular regard to trash (non-lint) content, and if pertinent by fiber length, strength and micronaire characteritics.

Bale opening may be accomplished by a gross bale opener of suitable design, the function of which is merely that of opening up the bale fiber from the relatively high density characteristic of incoming compressed bale fiber to smaller fiber aggregates of lower density, thereby facilitating the controlled automatic feed of the fiber to subsequent coarse opening and cleaning stages. The subsequent coarse opening and cleaning stages consist of one or more substages of coarse opening and cleaning equipment such as an inclined step cleaner or other known fiber cleaners such as manufactured by Fiber Control Corporation. Fiber leaving one or more coarse opening and cleaning stages may then be conveyed to one or more stages of intermediate fine opening and cleaning equipment such as the known Shirley opener-cleaner and/or other opener-cleaners such as a Fiber Controls model 310 fine opener-cleaner or a Fiber Controls model C60 opener-cleaner.

Controlled uniform fiber feed transfer from the intermediate fine opening and cleaning stages is next achieved by fiber batt formation to satisfy high fiber mass feed rate and fiber area density feed uniformity desired for efficient operation of the very fine opening and cleaning fiber treatment unit described below. Such a fiber batt may be formed using a modified fiber feed chute known for conventional textile carding feed systems, or the fiber may be discharged onto one or more condenser cylinders from which a more uniform batt of desired density can be removed or "doffed".

The very fine opening and cleaning stage is accomplished utilizing the process and apparatus of the present invention as more fully described herein.

Output from the very fine opening and cleaning stage may, if desired, be passed directly to a finisher card for preparation of card silver for yarn spinning, or to a chemical cleaning operation. Alternatively, the output from the very fine opening and cleaning stage is first subjected to a primary batt forming stage, which may be followed by a plaiting stage if desired, and two or more of these webs may then be plied or otherwise combined to form a consolidated batt of desired weight (area density) and fiber blend ratios. In one of the two systems, the consolidated batts so formed, either batch, semi-continuously, or continuously, serve as a uniform batt feed which is supplied to subsequent finisher cards for ultimate conversion to card sliver to be used to spin yarn in this first cotton fiber total system. In an alternate system, the output from the very fine opening and cleaning stage, either directly from the consolidated batt former or from the primary batt former or from the plaiter, is used to supply a continous chemical cleaner or a batch kier for preparation of cleaned cotton fiber for subsequent non-woven or yarn spinning operations. In another alternate system, the output from the very fine cleaner may be used to supply the continuous chemical cleaner or a batch kier either directly, by way of a chute feed, or by way of a condenser batt former.

To summarize, the output from the very fine opening and cleaning stage, for example, a carding machine, may be transported as loose fiber directly away from a carding machine to either: a chute feed device; a chute feed batt former device; a condenser device; or a condenser batt former device. Alternatively, a lightweight web from the doffer roll of a caring machine may be then: plied with other similar webs to form a consolidated heavier batt; plaited to form a heavier batt; or plaited to form an intermediate weight batt which in turn is plied with other intermediate weight batts to form a heavier consolidated batt. The various alternative forms of loose fiber, or fiber batt or web may be fed to either finisher cards to produce card sliver for yarn spinning or continuous chemical cleaning or wet processing equipment or batch-kier equipment to further prepare the fiber for either yarn spinning or for nonwoven web formation.

Figure 2:
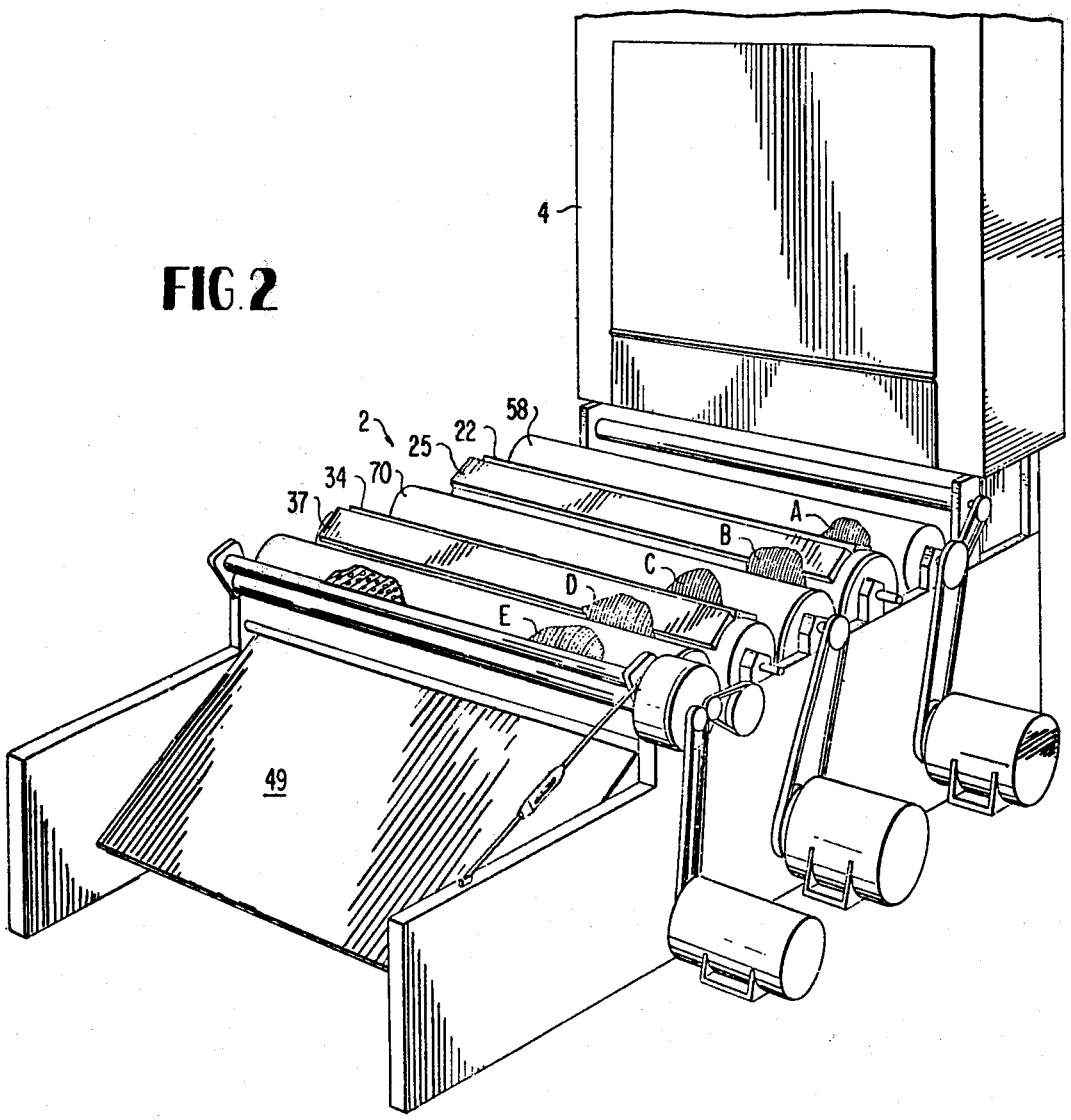
FIG. 2 is a perspective, partially broken away view of a preferred fiber treatment unit of the present invention.
Figure 3:
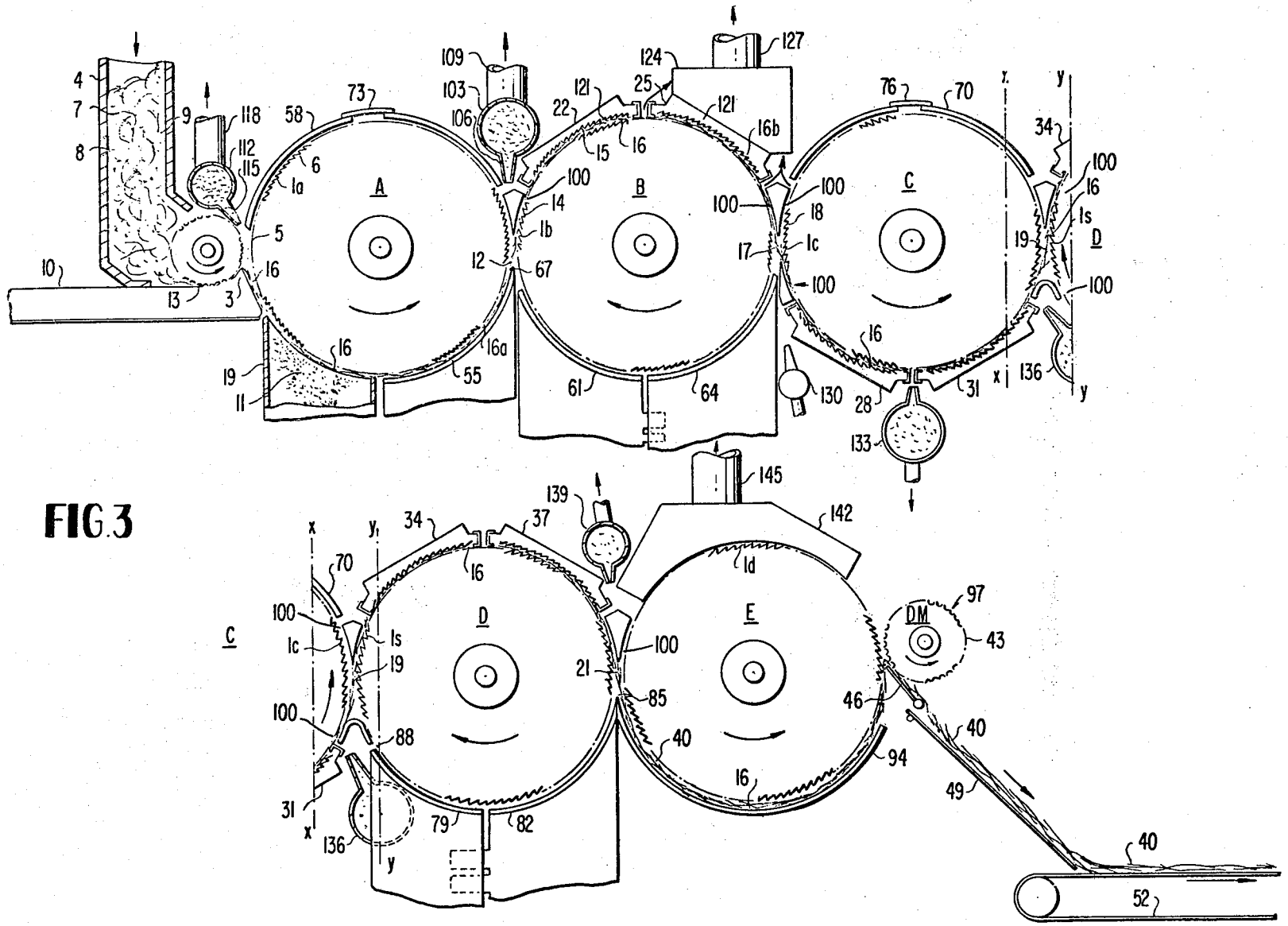
FIG. 3 is a simplified cross-sectional side elevational view of a portion of the fiber treatment unit shown in FIG. 2 together with additional trash-removing devices.

Referring to FIGS. 2 and 3, it will be seen that a preferred fiber treatment unit of the present invention may comprise a train of rolls, designated A, B, C, D, and E, adjacently mounted for rotation about parallel axes. Roll A functions as a lickerin; rolls B, C, D are main treatment cylinders; and roll E is a consolidating cylinder. An important feature of the invention is that adjacent rolls rotate in opposite directions; or stated differently, alternate rolls rotate in the same direction. Thus, as indicated by the arrows on the respective rolls in FIG. 3, rolls, A, C and E rotate counterclockwise, while rolls B and D rotate clockwise.

Each of the rolls A, B, C, D, and E in the train is provided with a plurality of fiber-grabbing, card clothing teeth 1*a*, 1*b*, 1*c*, 1*s*, and 1*d*, respectively, secured to the peripheries of the rolls. Another important feature of this invention is the angle at which these teeth are inclined. Thus, as shown in FIG. 3, the teeth on rolls A, B, C, and D have a substantial forward rake angle. That is, the forward faces of the teeth on the cylinders A, B, C, and D are all inclined at a substantial angle, e.g., from about 3° to about 50° and more typically from about 5° to about 40°, with respect to a radius, in the direction of rotation of the particular roll on which they are mounted. However, on consolidating roll E, the teeth are inclined at similar angles but opposite to the direction of rotation, that is rearwardly. It should also be noted here that in addition to or in lieu of teeth, roll E may be perforated as illustrated in FIG. 2 to allow for air suction to assist or by itself hold the mass or web of fibers onto the cylinder. If roll E is perforated but without teeth, some fiber disparallelization may occur during condensing of the web. Similarly, the rolls A, B, C or D may be perforated (not illustrated) to allow for such an air suction or vacuum holding technique. Such an air suction or vacuum holding technique may also allow for additional dust or other fine trash removal.

Preceding the train of rolls is a means, such as chute 4, to continuously supply a mass of fibers 7, from a source not shown, to be treated. These fibers can be natural, e.g., cotton; synthetic, e.g., nylons and polyesters, or blends of both natural and synthetic.

Referring once more to FIGS. 2 and 3, the trash-containing fibers are seen to pass from chute 4 to feed plate 10, from which they are transferred by feed roll 13 to teeth 1*a* of cylinder A. As the fibers are plucked from the feed roll and travel in a counterclockwise direction around the lower portion of the periphery of cylinder A, they are subjected to an initial orientation, combing, and cleaning action and form a layer 16. In the nip or rolls A and B, the layer 16 is transferred to teeth 1*b* of the second treatment cylinder B and assumes a clockwise path, as shown in FIG. 3, around the upper portion of the periphery of that roll. As the layer of fibers 16 next enters the nip of rolls B and C the fibers are picked up by teeth 1*c* of the third cylinder C and continue in a counterclockwise direction along the lower portion of the periphery of that roll. In a similar manner, the layer 16 is then successively transferred to teeth 1*s* on clockwise rotating roll D. Because, as already described, adjacent rolls rotate in opposite angular directions, the layer of fibers assumes the sinuous path shown as it progresses from roll A to roll E.

Because the peripheral speed of cylinder A is greater than that of feed roll 13, the layer of fibers 16 is of a lower density than that of the mass supplied to the feed roll 13. In addition, the rotational speed of layer 16, as it is carried around the lower portion of cylinder A is sufficient to cause a substantial amount of the heavy trash, loosened or freed by the teeth 1*a*, together with a certain percentage of fiber, to be thrown off by centrifugal force and by the transversely striking forces applied by the teeth 1*a* as they come into contact with the heavy trash. These are drawn into a conventional fiber retriever 19, a portion of which is shown in FIG. 3, adjacent a sector of the periphery of roll A. As layer 16 enters the nip of rolls A and B, it is picked off from teeth 1*a* by teeth 1*b* of the second cylinder B. The latter, because it rotates at a greater peripheral speed than cylinder A, has a drafting and carding effect at the point of transfer in the nip of the two rolls. Additional carding points along cylinder B are provided by a pair of adjacent stationary carding plates 22 and 25 mounted in juxtaposed relationship to sectors of the periphery of roll B. These stationary plates, coextensive with the length of the roll, have their inner, concave surfaces furnished with card clothing whose teeth may also be inclined, at varying angles to a radius, in the same direction or opposite to the direction of rotation of roll B. Stationary carding plates, such as plates 22 and 25, are described in detail in U.S. Pat. No. 3,604,062, which is incorporated herein by reference. These plates are adjustably mounted on the supporting framework (not shown) in a manner familiar to skilled mechanics, and are set at the proper distance from the roll for optimum carding effect. Optionally, plates 22 and 25 may be either spring-loaded or in a fixed position after adjustment.

The now partially carded fibers 16, traveling in a clockwise direction with roll B, are transferred to roll C in the nip between the two rolls. Roll C rotates at a peripheral speed greater than that of roll B. Hence, fibers 16 are subjected to further carding and drafting during the transfer. An important further novel feature of the present invention relates to the two additional carding points provided on the periphery of roll C. These additional carding points comprise stationary carding plates 28 and 31, similar to plates 22 and 25. Carding plates 28 and 31 are adjustably mounted, either rigidly or spring-loaded, in a juxtaposed position to the periphery of roll C, but adjacent a sector substantially diametrically opposite the sector on roll B where plates 22 and 25 are mounted. The effect of so locating plates 28 and 31 is to subject opposite surfaces of the layer of fibers 16 to carding action. After passing stationary carding plates 28 and 31, in a counterclockwise direction, fibers 16 are transferred from third cylinder C, to fourth cylinder D, which rotates clockwise. Because cylinder D rotates at a peripheral speed greater than that of roll C, carding action and drafting also take place in this transfer. This carding action is augmented by the juxtaposition of stationary carding plates 34 and 37 adjacent the sector of roll D corresponding to that of roll B, to provide still two more carding points. As in the instances of plates 22, 25, 28, and 31, carding plates 34 and 37 are mounted to be adjustable in a known manner, and they may either be rigid or spring-loaded after adjustment.

By the time fibers 16 reach the nip between rolls D and E, they have been so drafted and attenuated that they will not form a self-sustaining continuous web. Accordingly, the roll E is rotated in an opposite direction to (e.g., counterclockwise) and at a peripheral speed substantially lower than that of roll D. Furthermore, by inclining the teeth 1*d* on roll E at an angle opposite to the direction of rotation, the fibers, as they transfer from roll D to roll E, are subjected to a condensing action. The fibers 16, now in the form of a denser, self-sustaining web 40, are presented to a fluted roll 43 (DM) which also rotates in a counterclockwise direction, thereby removing or doffing web 40 from roll E. The web 40 then passes between the fluted roll 43 and a knife edge 46 causing the web to slide down the stationary inclined surface 49 to an endless belt 52 for recovery or for removal to a location for further processing. An assembly for removing the condensed web 40 from roll E, as just described is further described in detail in U.S. Pat. No. 3,283,366, which is incorporated herein by reference.

In a preferred embodiment, as shown in FIGS. 2 and 3, rolls A, B, C, D, and E are of the same diameter, although this is not a requirement. A preferred diameter for the rolls A, B, C, D, and E has been found to be approximately 9 inches. Once again, however, other diameters or combinations of various diameters for the plurality of rolls is intended and is within the scope of the present invention. Having identical diameters, however, affords the additional advantage of increased economy of manufacture since it is not necessary to obtain rolls of varying sizes to construct the several components.

As indicated previously, one of the prime objectives of the present invention is to provide a cotton fiber treatment unit capable of a hitherto unobtainable combination of quality and output. Thus, where a conventional card will produce up to about 60 or 70 pounds per hour of a cotton web suitable for scouring and bleaching, the treatment unit herein described is capable of producing over 400 pounds and up to about 700 pounds or more per hour of a high quality cotton web. By "high quality" is meant substantially uniform area density, uniform texture, substantial absence of formation of neps, with a very substantial reduction in the amount of residual fine trash such as small seed fragments and other coloring bodies referred to as "pepper trash". It should be noted, however, that if the input to the fiber treatment unit or process of the present invention already contains neps (which are very tightly twisted and interlocked fine fibers), such neps may not be removed. Rather, formation of new neps is avoided or minimized.

Because a great deal of the trash removal normally occurs at the junction or zone between the feed roll and cylinder A, it is typically advisable to provide a high capacity fiber and trash receiving component adjacent that portion of the periphery just beyond feed roll 13 and feed plate 10. Already mentioned as being suitable for this purpose is a conventional fiber retriever, various designs of which are well known to those familiar with this art. A portion of the receiving duct 19 for such a fiber retriever is shown in FIG. 3. Screen or shroud 55 is contoured to be concentric with cylinder A and is adjustable with respect to its distance from the periphery of the latter by conventional means (not shown). A conventional bonnet 58 is also shown to cover a sector opposite screen 55. This plate is also adjustable by means (not shown) similar, if desired, to those used for adjustably mounting stationary carding plates 22 and 25, for example. Means for adjustably mounting the cover plates are known and do not constitute a part of the present invention.

Referring once more to FIG. 3, toothed cylinder B is seen to be provided with screens 61 and 64 substantially diametrically opposite stationary carding plates 22 and 25. Screens 61 and 64 are concentrically concave with the periphery of toothed cylinder B and are adjustable with respect to their distance from that periphery by conventional means (not shown) which also do not constitute part of the present invention. These screens are, preferably, solid, as shown, for reasons which will be explained below; but can also be perforated or ribbed. Screens 61 and 64, respectively extend from a point adjacent the forward edge 67 of screen 55 to a point almost in the nip of rolls B and C, a sector normally corresponding to about one-third of the circumference of roll B.

Turning attention now to roll C, it will be seen from FIG. 3 that this roll is provided with a concentrically concave cover plate 70 substantially diametrically opposite stationary carding plates 28 and 31. Plate 70 is also adjustably mounted, by means not shown, in a manner similar to that of cover 58. Optional, but not necessary, are windows 73 and 76 in covers 58 and 70, respectively, which can be provided for the purpose of inspecting the condition of the card clothing and for detecting any occurrence of "blowback", which are fibers torn loose from one area of the web and eventually repositioned in another area of the web, thus leading to non-uniformity in the web.

Again referring to FIG. 3, cylinder D is seen to be provided with adjustable (by means not shown) solid screens 79 and 82, similar to screens 61 and 64, adjacent a sector of the periphery of cylinder D substantially diametrically opposite stationary carding plates 34 and 37. Screens 79 and 82 together cover about one-third of the circumference of cylinder D, extending, in the direction of rotation from a point 85, near the nip of rolls D and E to a point 88, substantially distant from the nip of rolls C and D. A curved plate 90 extends from point 85 around a sector of roll E, corresponding substantially to the sector of roll D encompassed by screens 79 and 82, to a point 94 adjacent the web-doffing assembly designated generally as 97.

In order to achieve the stated objective high capacity, it is typical to rotate the several rolls at higher than conventional card peripheral velocities. Also, in order to achieve the additional stated objective of producing a clean, high quality web from certain fibers it is preferable to provide a carding action at a point not previously used, namely, at an intermediate roll (C), and along a sector substantially diametrically opposite to the sectors along which carding takes place on two adjacent rolls (B and D). Furthermore, as previously noted, it was found that all cylinders could be of the same diameter.

Air currents may be controlled so as to prevent blowback of fibers to a preceding cylinder member by using the above-described screens. In this manner, and augmented by the application of negative air pressure in the nip zone areas of the rolls, it is possible to achieve the proper flow of air around the cylinders and in the nips of adjacent cylinders to effectively transfer all of the fibers and maintain them in the previously described sinuous path as they proceed from cylinder A to cylinder E.

Although, as previously noted, a great deal of the cleaning (i.e., removal of heavy trash carried by the baled, ginned cotton) takes place at cylinder A where the heavy trash, together with some fiber, is thrown off by centrifugal and tangential forces and caught in fiber retriever 19, some smaller trash particles typically remain in the fibers and continue around the periphery of cylinder A past the entrance duct of fiber retriever 19. This remaining trash, together with the fibers is picked up by the next cylinder B. Some of this trash, particularly the loosely-held surface trash, together with some lint and dust is removed from the body of fibers by means of a cleaning device, designated generally by the reference character 100, and shown schematically near the nip of rolls A and B. This trash removing device is the subject of U.S. Pat. No. 3,858,279 and is incorporated herein by reference. The loose material removed by the trash cleaner 100 is sucked into vacuum pipe 103 through nozzle 106, substantially coextensive with the length of roll A, pointed into the nip of rolls A and B. Pipe 103 is connected to any suitable suction device (not shown) by means of duct 109.

Loose trash not removed by vacuum pipe 103, together with trash and fibers adhering to feed roll 13 are removed by vacuum pipe 112 through nozzle 115, also substantially coextensive with the length of roll A, pointed into the nip of feed roll 13 and cylinder A. Vacuum pipe 112 can be connected by duct 118 to the same suction device as duct 109.

As the body of fibers is transferred from cylinder A to faster-moving roll B it undergoes drafting and carding, processes which, as previously described, are augmented by stationary carding plates 22 and 25. This carding and drafting action results in an attenuation of the body of fibers and a loosening of a quantity of trash exposed by the further opening of the fibers, especially those on the surface in contact with teeth 121 on carding plates 22 and 25. The trash, dust, and stray fibers are drawn off through plenum 124 which covers carding plate 25 and extends over the nip of rolls B and C. Plenum 124 can also be connected by means of duct 127 to the same suction device as ducts 109 and 118.

The mass of fibers 16, as they transfer from roll B to faster-rotating roll C, are again subjected to drafting and carding actions, thus further reducing the density of fibers 16 and loosening or exposing a further amount of remaining fine trash. At this point there comes into play one of the novel concepts of the present invention.

Until the present invention, carding cotton webs have been considered and assumed by those working in this art to be only two dimensional, that is, length and width but without substantial thickness which had to be taken into account. However, this erroneous assumption was in a large measure responsible for inhibiting the development of high speed, high capacity carding capable of producing a substantially trash-free web which was acceptable for further industrial use without having to be run through a finisher card. Abandoning the just mentioned assumption that the particularly carded web was two dimensional and considering it to have a finite thickness, the present invention involves the advantageous step of carding the opposite surface of web 16. This may be done by installing stationary carding plates 28 and 31 adjacent roll C, as previously described, about 180° removed from the preceding plates 22 and 25 on roll B. The surface trash, loosened by the carding action of plates 28 and 31 can be removed by installing additional units of the previously mentioned trash-removing devices 100 in the nip of rolls B and C, as shown in FIG. 1. Loosened trash, dust and lint can then be removed by vacuum pipes 130, 133 and 136 similar to those previously described.

The already attenuated web 16 is then further drafted and carded in the nip of rolls C and D as it is transferred to the latter. Also, as already described web 16 is subjected to further carding action by stationary carding plates 34 and 37. Further residual trash is loosened by the carding and drafting action in the nip of rolls C and D and under stationary carding plates 34 and 37, and separated from the surface of the web by the knife blades of a further pair of trash-removing units 100, one of which can be installed near the nip of rolls C and D before carding plate 34 and the other after carding plate 37, as shown in FIG. 3. The so separated trash, dust, and lint can then be drawn off through vacuum pipe 139 and through plenum 142 which is connected to a source of vacuum (not shown) by duct 145, in the manner already described.

Web 16, as it enters the nip or rolls D and E, is deposited on the rearwardly inclined teeth **1*d* of the slower-rotating roll E. The increase in density or weight per unit length of the more dense web 40 depends on the relative speeds of D and E. The web 40, free of trash, self-sustaining, and completely opened is removed from roll E by means of the previously mentioned doffing assembly 97 and deposited on conveyor 52** for transportation to the next intended operation.

In the foregoing description, reference was made to the several trash-removing assemblies and to the suction devices used to collect the loose trash, lint, dust, and the like. These suction devices serve the additional purpose of maintaining zonal portions of the breaker card under negative pressure. This condition advantageously provides for removal of the trash and other dry particles by suspending them in a direct, moving stream of air, thus preventing escape of such particles into the atmosphere and thus minimizing health hazards at this and subsequent fiber process stages.

Figure 4:
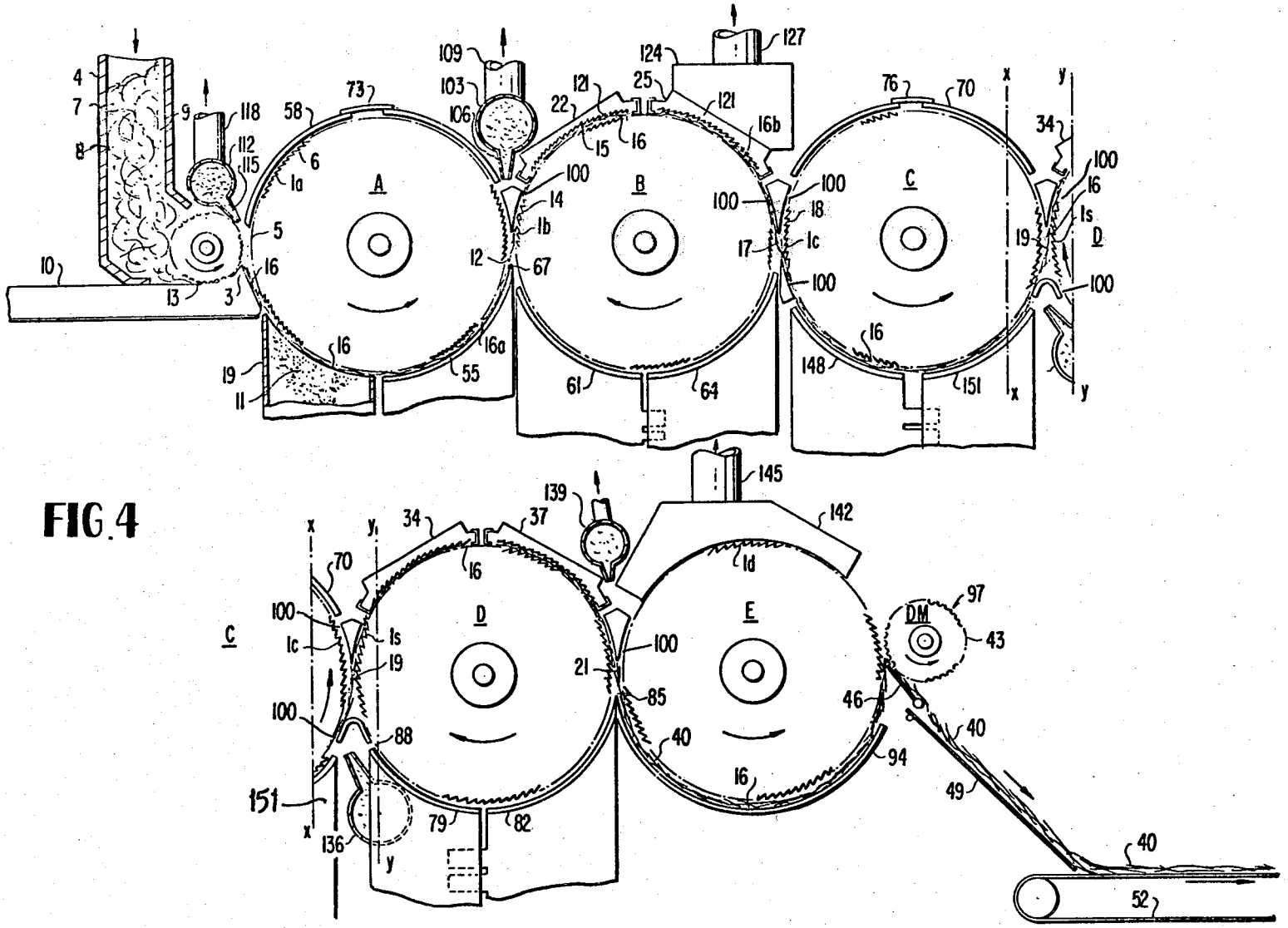
FIG. 4 is a simplified cross-sectional side elevational view of a portion of a modified version of the fiber treatment unit shown in FIG. 2 together with fewer trash-removing devices.

In operation, and referring to FIGS. 2 and 3, a gross or thick mass 7 of tangled randomly oriented trash containing cotton fibers may be treated by the fiber treatment unit 2. This is accomplished by providing a mass 7 of fibers in a batt form having longitudinal and lateral dimensions substantially greater than its dimensional thickness, with opposite face portions 8 and 9 of the batt. The batt may be of varying dimensions and weight, e.g., above about 2,000 grains/yd.$^2$ and typically between about 2,000 and about 20,000 grains/yd.$^2$ and typically with a standard width of 42 inches. The mass 7 of fibers is then relatively slowly conveyed in the batt form from a feed roll 13 to a first junction 3 at a suitable rate of above about 400 pounds per hour while tightly gripping or holding the mass, to maintain the gross mass of fibers substantially stationary in a direction generally transverse or perpendicular to the longitudinal or initial feed direction. It should be noted here that usage of the term "longitudinal" does not necessarily imply a horizontal direction or a vertical direction, as the fiber treatment process and unit may be operated in a variety of configurations and spatial relationships as otherwise discussed herein. The peripheral speed of the feed roll may vary, and typically is between about 10 and about 100 feet per minute. The mass 7 of fibers is then directed against teeth **1*a* on a mid-point of a cylindrical surface 5 of a first rotating cylinder A, the teeth 1*a* having forward faces 6 inclined at substantial angles in the direction of rotation of the cylinder as shown by the arrows in FIG. 3. This causes a sudden deflection at the first junction 3 to cause the leading portions of mass fractions of fibers to experience an abrupt deflecting motion generally transverse to the longitudinal travel direction and simultaneously subjects the leading fiber portions of the mass fractions to an abrupt accelerating force in a first circular direction of travel for the fibers, as shown by the arrows in FIG. 3. This force tends to accelerate the mass fractions in the travel direction to a relatively high speed, e.g., above about 2,000 feet per minute, typically between about 2,000 and about 6,000 feet per minute, and preferably between about 3,000 and about 5,000 feet per minute. The deflecting in the transverse direction and accelerating in the circular travel direction while gripping the gross mass of fibers effects plucking or pulling of mass fractions or portions from the gross mass of tangled, randomly oriented fibers, and assists in thinning and orienting (parallelizing fibers in the feed direction) the mass 7 in the travel direction and assists in disentangling the mass of fibers. The combined effects of the sudden transverse deflection, circular accelerating force and some combing by the teeth 1*a* also cause trash 11 to be thrown downwardly and outwardly and be freed and separated from the area of the mass of fibers by suitable devices 19 and 115. The mass of fibers at a second junction 12 downstream of the first junction 3 is then directed tangentially against teeth 1***b* on the cylindrical surface 14 of a second rotating cylinder B, the second cylinder rotating in a direction opposite the first cylinder A and having teeth 1*b* with forward faces 15 inclined at a substantial angle in the direction of rotation of the second cylinder B, so as to cause a generally tangential accelerating force applied by the teeth 1*b* of the second cylinder B to the fibers in the second circular travel direction sinuous to the first or upstream circular travel direction and to cause mass fractions of the fibers to accelerate freely or virtually unhindered or unretarded in the second circular travel direction as shown by the arrows in FIG. 3, from the teeth 1*a* of the first cylinder A. This tangential or sinuous transfer from cylinder A to cylinder B also effects a carding of a first face portion or surface 16*a* of the layer 16 or mass fractions of fibers at the second junction 12. The combined effects of accelerating tangentially or sinuously and carding on a first face portion 16*a* tend to thin or draft apart the individual fibers in the travel direction and aid in loosening of trash and disentangling of individual fibers in the mass of fibers. At a third junction 17 downstream of the second junction or location 12 the mass or layer 16 of the fibers is directed tangentially against teeth 1*c* on cylindrical surfaces 18 of a third rotating cylinder C. The third rotating cylinder C rotates in a direction opposite the rotation of the second cylinder B and has teeth 1*c* with forward faces inclined at a substantial angle in the direction of rotation of the third cylinder C, as shown in FIG. 3. A generally tangential acceleration is applied by the teeth 1*c* of the third cylinder C to the fibers in the third circular travel direction sinuous to the second or upstream travel direction to cause the fibers to accelerate freely in the third circular travel direction from the teeth 1*b* of the second cylinder B. Speeds at cylinder C may vary, but are generally between about 5000 feet per minute to above about 10,000 feet per minute, typically between about 5,000 and about 9,500 feet per minute, and preferably are between about 7,000 and about 8,000 feet per minute. Carding of a second opposite face portion 16*b* of the mass or layer 16 of the fibers is effected at the third junction or location 17. The combined effects of accelerating sinuously and carding on the second or opposite face portion 16*b* tends to thin and draft apart individual fibers in the travel direction and tends to separate and disentangle individual fibers and aids in loosening of trash from the fibers. The mass 7 of fibers is subjected at the junction 19 and cylinder D to the same operation and effects as at junction 12 and cylinder B. If desired, cylinder D may be omitted in certain instances such as when dealing with a fiber feed of lower trash content and/or higher initial orientation and higher initial uniformity and initial finer opening. Also, if desired, additional toothed carding or non-toothed transfer cylinders beyond the three carding cylinders B, C and D as shown in FIGS. 2, 3 and 4, may also be used at various peripheral speeds. After effecting treatment as described above in conjunction with cylinders A to D the mass 7 of fibers may then be condensed by subjecting the mass 7 at a junction 21 downstream of the fourth junction 19 by directing the mass of fibers against the slower moving cylinder E so as to condense the fibers by subjecting them to a tangential decelerating force in a circular travel direction sinuous to the circular travel direction of the preceding fiber treatment cylinder which causes consolidating of the individual fibers and condensing of the card web while maintaining orientation and disentanglement of the individual fibers. At various points (22,25), (28,31) and (34,37), the mass of fibers may be additionally carded on the exposed face portions of the batt while the mass of fibers are in a circular travel direction of travel at a constant velocity so as to cause a retarding effect on fiber portions in the carded face portions while the velocity of remaining fiber portions in the batt is being maintained, thereby aiding in orienting and separating individual fibers in the travel direction and laterally thereof and aiding in further fiber disentanglement and loosening of trash in the mass of fibers. Also, a number of devices 19, 106, 115, 130, 133, 136, and 139 are provided for conveying loosened and freed trash away from the mass 7 of fibers. The consolidated fiber batt may then be removed or doffed from the consolidating cylinder E by a conventional fluted doffing roll 43 (DM) so as to recover a consolidated, substantially trash-free and substantially nep-free mass of fibers. At the consolidation stage, i.e., on cylinder E, the mass of fibers may have a varying density typically below about 1200 grains per square yard, on a wire wound doff roll. Much higher consolidation area densities may be obtained by employing a perforated condensing cylinder.

Reference has frequently been made to the progressively increasing velocities on peripheries of the several rolls which enable the fiber treatment unit of the present invention to deliver up to or exceeding about 400 to 700 lbs. per hour of a high quality clean, carded cotton suitable for continuous direct delivery to a chemical treatment operation or to conventional finisher cards used to prepare sliver for spinning, or even for delivery to spinning apparatus. It will be realized that the quantity and quality of output of the treatment unit are determined by the amount of raw material initially fed to cylinder A and the speeds of the latter cylinders. Also, it should be noted that, as the peripheral speeds of adjacent cylinders increase, teeth or point density on the cylinder surfaces typically increases, as may be evident to one of ordinary skill in this art in view of the present specification. For example, one set of possible construction and operation details to produce 700 pounds per hour are listed in Table I, below, for 9-inch diameter rolls with a standard width of 42 inches (with reference of FIG. 3). Other appropriate values for the points per sq. in. may vary from those displayed in TABLE I below, by factors up to four or more times the indicated values.

TABLE I

| Roll | Roll Dia (in) | RPM | SFM | Points per sq. in. | Rake Angle |
|---|---|---|---|---|---|
| A | 9 | 2,000 | 4,712 | 24 | +10° |
| B | 9 | 4,000 | 9,424 | 120 | +15° |
| C | 9 | 6,000 | 14,137 | 196 | +15° |
| D | 9 | 8,000 | 18,849 | 224 | +15° |
| E | 9 | 150-500 | 353-1,178 | 240 | +40° |
| DM | 3.5 | 460-1800 | 422-1,649 | n. app. | n. app. |

Table II, below, lists one set of possible characteristics of the stationary carding plates:

TABLE II

| Plate | Points/sq. in. | Angle of Teeth |
|---|---|---|
| 22 | 560 | +10° |
| 25 | 560 | +10° |

TABLE II-continued

| Plate | Points/sq. in. | Angle of Teeth |
|---|---|---|
| 28 | 560 | +10° |
| 31 | 560 | +10° |
| 34 | 560 | +10° |
| 37 | 560 | +10° |

In Table III, below, there are tabulated the approximate results of several runs of a fiber treatment unit as shown in FIG. 3, with roll and plate dimensions as shown in TABLES I and II. The column headings are self-explanatory.

TABLE III

| Run | Input Lb/Hr | Speed R.P.M. A | B | C | D | E | DM | Output Density gn/yd² | Output lbs/hr |
|---|---|---|---|---|---|---|---|---|---|
| 1 | 400 | 1500 | 2750 | 3400 | 4275 | 85 | 290 | 400 | 400 |
| 2 | 1200 | 1500 | 2750 | 3400 | 4275 | 500 | 1700 | 205 | 1200 |
| 3 | 400 | 1500 | 2750 | 3400 | 4275 | 500 | 1700 | 68 | 400 |
| 4 | 1200 | 1500 | 2750 | 3400 | 4275 | 85 | 290 | 1200 | 1200 |

In Table IV, below, preferred speed ranges have been calculated for a fiber treatment unit as shown in FIG. 3, with rolls A–E all having a standard diameter of 9 inches:

TABLE IV

ROLL SURFACE SPEEDS (S or v) AND CENTRIPETAL ACCELERATIONS (a) FOR ROLL DIAMETER D = 9.0 IN., RADIUS r = 4.5 INCHES = 0.375 FT.

| ROLL | | S = FT/MIN. | v = FT/SEC | $v^2$ = FT²/SEC² | a = $v^2/r$, FT/SEC² |
|---|---|---|---|---|---|
| A | MINIMUM | 2,000 | 33.33 | 1111 | 2,963 |
| | MAXIMUM | 5,000 | 83.33 | 6944 | 18,519 |
| | AVERAGE | 3,500 | 58.33 | 3402 | 9,074 |
| B | MINIMUM | 4,500 | 75.00 | 5625 | 15,000 |
| | MAXIMUM | 7,000 | 116.67 | 13611 | 36,296 |
| | AVERAGE | 5,750 | 95.83 | 9184 | 24,490 |
| C | MINIMUM | 5,800 | 96.67 | 9344 | 24,919 |
| | MAXIMUM | 9,500 | 158.33 | 25069 | 66,851 |
| | AVERAGE | 7,650 | 127.50 | 16256 | 43,350 |
| D | MINIMUM | 7,000 | 116.67 | 13611 | 36,296 |
| | MAXIMUM | 14,000 | 233.33 | 54444 | 145,185 |
| | AVERAGE | 10,000 | 170.00 | 28900 | 77,067 |

In Table V, below, angular speeds have been calculated for a fiber treatment unit as shown in FIG. 3 at the preferred speed ranges of TABLE IV:

TABLE V

9-INCH DIAMETER ROLL SPEEDS

| ROLL | SURFACE SPEED = S FEET PER MINUTE: MINIMUM | MAXIMUM | AVERAGE | ANGULAR SPEED, α = S/0.75 II, = 0.42441317S, REVOLUTIONS/MIN.: MINIMUM | MAXIMUM | AVERAGE |
|---|---|---|---|---|---|---|
| A | 2000 | 5000 | 3500 | 848.8 | 2122.1 | 1485.4 |
| B | 4500 | 7000 | 5750 | 1909.9 | 2970.9 | 2440.4 |
| C | 5800 | 9500 | 7650 | 2461.6 | 4031.9 | 3246.8 |
| D | 7000 | 14000 | 10500 | 2970.9 | 5941.8 | 4456.3 |

The combination of relatively high roll surface speeds (see Tables IV and V) with relatively small roll diameters (e.g., 9-inch diameters) provides a significant improvement in trash and dust separation at relatively high fiber mass processing rates. This is believed to be due, in part, to the higher centrifugal forces imparted to trash particles as the surface speed is increased while the roll diameter is kept relatively small.

It is believed that the improved carding efficiency obtained from each of the carding plates may also be attributed, in part, to the higher centrifugal forces which result from the combination of high roll surface speeds coupled with smaller roll diameters. The fiber passing between the teeth of the carding rolls and the carding plates is thrown against the carding plates with a higher (centrifugal) force, thereby increasing the carding interaction between the roll and the carding plates. Hence to be effective, the driving means which is geared to the carding means should be arranged so as to provide the appropriate roll angular speeds for relatively small diameter rolls (e.g., 9-inch diameter rolls) which will result in the relatively high roll surface speeds as displayed in TABLE IV.

When the appropriate combination of roll diameters and roll angular speeds is also coupled with an arrangement of carding plates and with an arrangement of appropriate shrouding of the carding rolls and all of this is in turn coupled with appropriate vacuum-assisted means for removing trash and dust, means capable of carding, opening and cleaning cotton fiber at high production rates are obtained with a relatively small compact fiber treatment unit.

In the foregoing description of the preferred embodiment of the present invention reference was made only to the essential working components of the fiber treatment unit to simplify consideration of these essential details and to avoid undue complications by having to consider conventional supporting structure. Omitted from the description has been the conventional elements which would comprise any apparatus of the present category, namely a base, supporting structure, roll bearings, and complete drive means for the several rolls. These items do not constitute part of the present invention and are such that they can be constructed by any skilled mechanic. The rolls can be driven individually at their optimum speeds or they can be driven from a single prime mover with adequate chain or belt drives and proper gearing to achieve the desired speed ratios.

As already mentioned, the foregoing description related to a preferred embodiment of the invention. An alternate embodiment is shown in FIG. 4.

The embodiment of FIG. 4 differs from that of FIG. 3 in the omission of the stationary carding plates 28 and 31 from roll C. The fiber treatment unit is otherwise the same as that shown in FIG. 3 and could be used, for example, in carding relatively clean, non-neppy cotton or synthetic fibers where the problem of trash and dirt is not as great a problem, and therefore, does not require the greater degree of carding and cleaning normally required by the trashier or more neppy cotton grades.

In illustrating the two embodiments of FIGS. 3 and 4, the rolls were shown as being arranged horizontally with their parallel axes in a straight line. Although this is the preferred construction, the several rolls can be arranged if desired vertically, or their axes can be arranged in a zig-zag or other pattern. However, regardless of the pattern in which the axes of the several rolls are arranged, they will function in the manner described above, although from the point of view of simplicity of construction, the horizontal arrangement, as illustrated, is the preferred structure, particularly with respect to more effective trash removal. Moreover, tangential or sinusoidal acceleration from roll to roll need not be in equal increments. However, a draft ratio (ratio of speed of downstream roll to that of immediate upstream roll) of above about ten percent, and more typically above about twenty percent, is typically needed to provide sufficient drafting of fibers for loosening of trash and/or disentanglement of fibers, and to provide for efficient and smooth roll-to-roll transfer of the fibers. Also, it may be desirable to connect two or more fiber treatment units in tandem or series relationship to provide for an even greater degree of cleaning and/or fine opening and/or fiber orientation. Further, a portion of the fiber output from a fiber treatment unit may be recycled to the input chute or feed roll for additional treatment by the unit, if desired. It is also contemplated that the various trash removal devices and fiber retrieval devices may be vacuum assisted, if desired.

Figure 5:
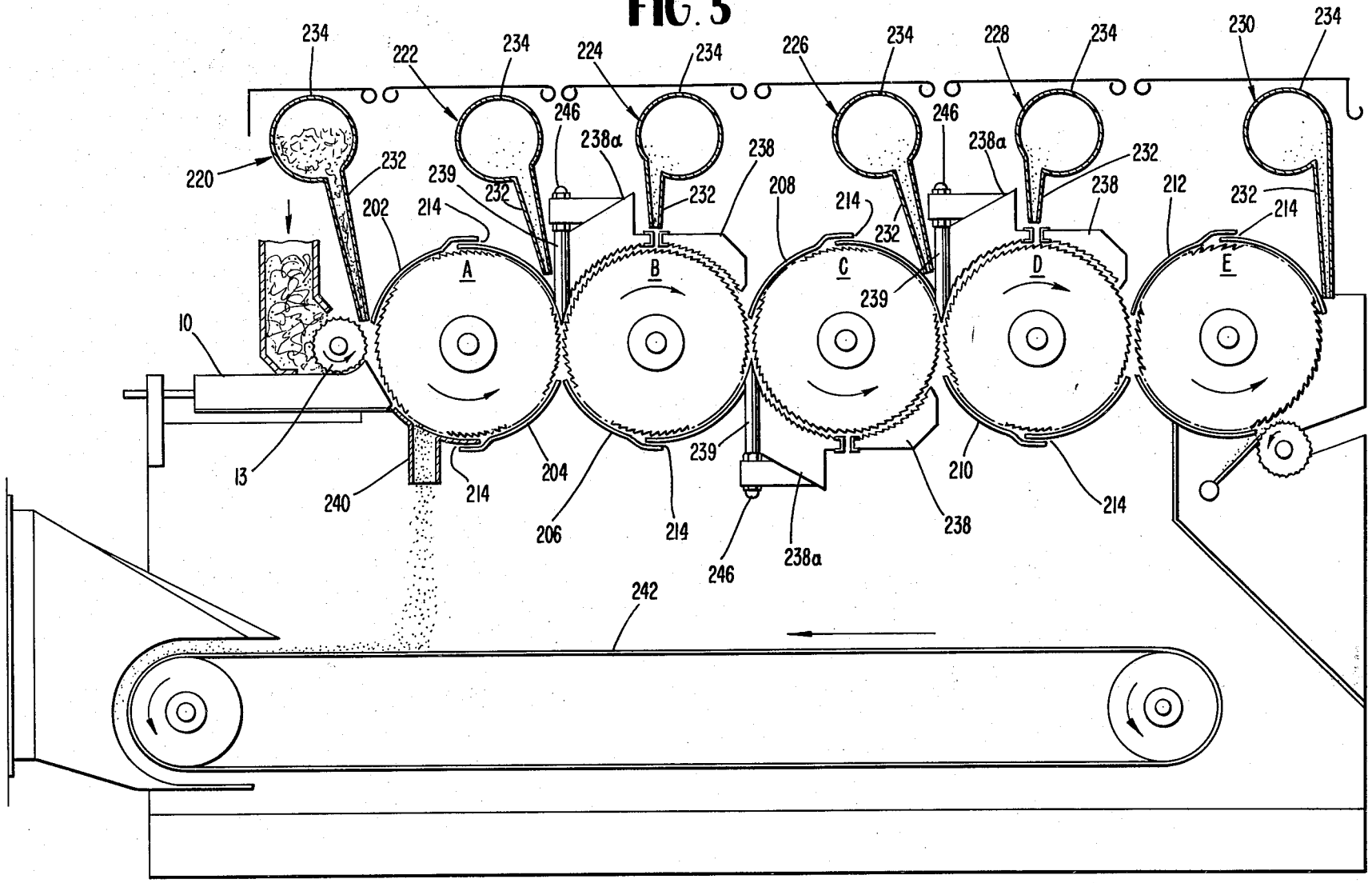
FIG. 5 is a schematic illustration of the portion of the fiber treatment unit shown in FIG. 2 having different shrouding, carding and air withdrawal arrangements.

With reference now to FIG. 5, the fiber treatment unit of FIG. 3 may be provided with a plurality of bonnets or shroud members 202 through 212. Each of the shroud members 202–212 has an opening slot 214 provided between adjacent portions of the shroud members and which extends in a direction opposite to the direction of travel of the roll. In this way, the opening slot 214 permits air to enter through the individual shroud members and to flow with the fibers or particulate waste between the shroud members and the closely adjacent roll surface. The shroud members are each provided with one of the opening slots 214 to permit air to be supplied to the respective portion of the fiber treatment unit. A significant amount of particulate trash may be recirculated around the various rolls, for example over the top of roll A. If the respective shroud member were removed, this trash would be thrown into the air and fly off of the cylinder surface, for example, as the trash was carried into the upper left hand quadrant of roll A. With the shroud member in place, however, the trash particles would be redeposited, for example, in the case of roll A onto a fiber batt entering the fiber treatment unit at the feed roll/feed plate.

With continued reference to FIG. 5, air withdrawal devices 220–230 are provided immediately above the train of rolls A–E with each air withdrawal device having a generally vertically extending vacuum slot portion 232. The air withdrawal devices 220–230 each have cylindrical portions 234 which combine with the generally tangentially arranged vacuum slot portions 232 to impart a spiraling air flow through the vacuum slot portion. The spiraling air flow tends to improve the flow of trash upwardly through the vacuum slot portions and outwardly through the air withdrawal device.

A pair of air withdrawal devices 220 and 230 are arranged at either end of the fiber treatment unit to remove trash both as the fibers are engaged by roll A and after the fibers leave roll E, respectively. A pair of air withdrawal devices 222, 226 are provided at the junction or location between adjoining rolls A–B and C–D, respectively. Finally, two air withdrawal devices 224, 226 are provided between pairs of carding plates 238 for the rolls B and D respectively.

All of the air withdrawal devices are provided generally vertically above the fiber treatment unit with a downwardly extending tangential slot 240 being provided for the shroud member 204 of roll A. The rolls A–E are arranged above a conveyor belt 242 which continuously receives the trash particles which fall vertically downwardly from the rolls either between the carding plates of roll C or through a gap or spacing provided between pairs of adjacent rolls, such as A–B and D–E.

The carding plates 238 of rolls B, C and D are substantially identical to one another and each includes a relatively heavy weight, machined, close fitting member **238*a* which is coupled to a knife blade 239. The knife blade is beveled to provide a close fit to the curved surfaces of the rolls at a junction between adjacent rolls. Mounting brackets 246** for the knife blades provide an adjustable feature for the blades so as to permit the spacing between the blade and roll surface to be varied. In this way, one may obtain an optimum arrangement for trash removal. Furthermore, a tendency for the fiber to recirculate around the upper portions of rolls A and C (i.e., "blow-back") and around a lower portion of roll B is minimized.

It should be noted that the feed roll 13 of FIGS. 3 and 5 is arranged with a feed roll center line (or axis) being arranged at a level of the center line axis of roll A. While this is not essential, such an arrangement, when coupled with a feed plate position appropriately corresponding to the feed roll, results in an optimum deflection of the fibers at the junction of roll A and the feed roll/feed plate. Preferably the feed plate is properly machined so as to obtain a significantly close fit with respect to the feed roll.

The preferred deflection of the fibers which results from a proper orientation of the feed roll with the feed plate and subsequently with the first roll A, is significant with respect to obtaining the appropriate, uniform supply of the fibers at the first junction or location between the feed roll and roll A.

Figure 6:
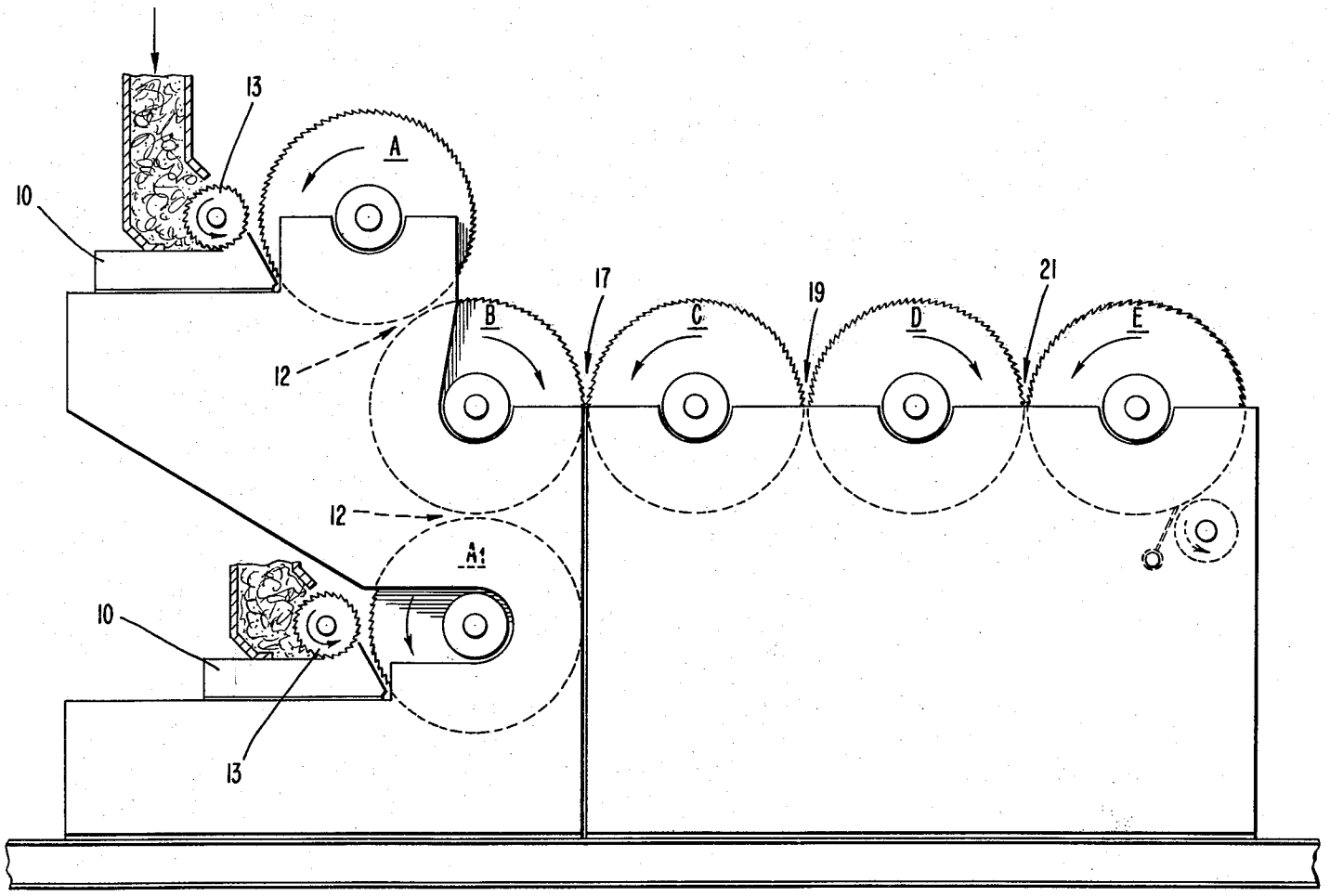
FIG. 6 is a schematic illustration of the portion of the fiber treatment unit shown in FIG. 3 having a plurality of fiber feed rolls/feed plates and a plurality of first rolls which supply fiber to a second roll.

With reference now to FIG. 6, an additional fiber treatment arrangement includes a plurality of feed roll-/feed plates which each supply fiber to a corresponding one of a plurality of first rolls A. Each of the feed rolls 13 cooperates with a respective feed plate 10 to provide fiber at a junction or location to each one of a pair of first rolls A. The pair of first rolls A are then oriented with respect to the second roll B so that each of the first rolls A may transfer the fiber carried by the first rolls A to the second roll B at a pair of second junctions 12.

It is believed that one problem with respect to producing high quality webs in rates in excess of 400 pounds per hour is related directly to the fiber/tooth ratio at the junction between the feed roll/feed plate and roll A. Therefore, a plurality of feed rolls/feed plates, each supplying fiber at a rate substantially half that of the fiber treatment unit of FIG. 3 would provide the second roll B with an amount of fiber necessary for a high rate of fiber production. Alternatively, each of the two rolls A may be supplied with a full supply of fiber at a rate substantially similar to the rate possible with the fiber treatment unit of FIG. 3, to produce still higher rates of fiber production than are believed possible with the fiber treatment unit of FIG. 3.

Figure 7:
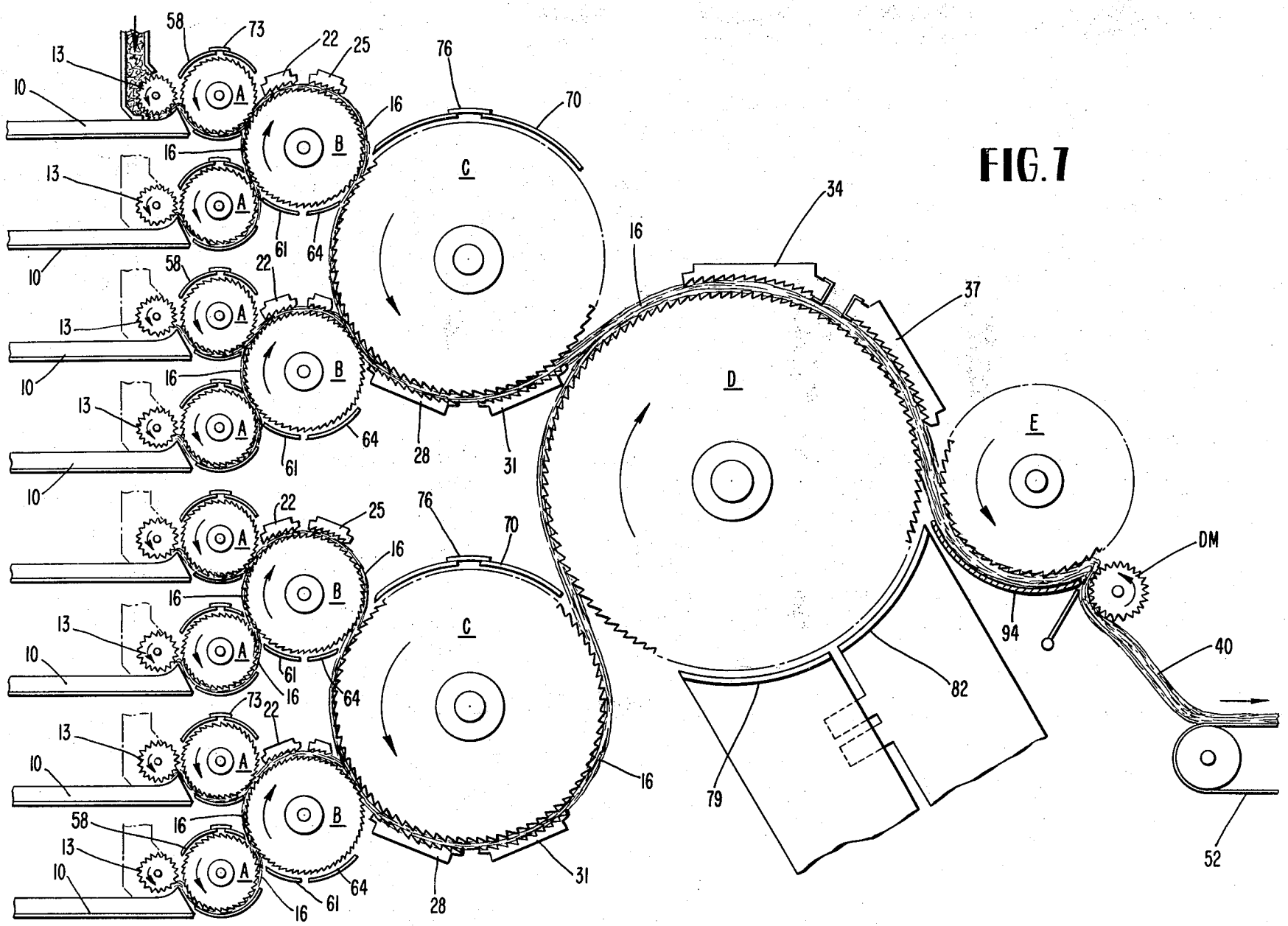
FIG. 7 is a schematic illustration of the portion of the fiber treatment unit shown in FIG. 3 having a plurality of fiber feed rolls/feed plates, a plurality of first rolls, a plurality of second rolls, and a plurality of third rolls all subsequently feeding a single fourth roll.

With reference now to FIG. 7, a still further increase in production capability may be possible by combining pluralities of the various rolls A, B and C in a manner so that each of the rolls B, C and D is supplied with fiber from a pair of respectively preceeding rolls. In this way, four pairs of first rolls A and corresponding feed rolls/-feed plates would supply fiber to four second rolls B. The four second rolls B would be arranged in two pairs to supply fiber to each of a pair of third rolls C. Finally these two third rolls C would supply a single fourth roll D. Variations of such a arrangement will become readily apparent to one skilled in the art and are intended to be within the scope of the present invention.

With continued reference to FIGS. 6 and 7, appropriate carding plates and shroud members are provided for the apparatus in the manner described with respect to the fiber treatment unit of FIGS. 3 and 4.

Especially with respect to the arrangement of FIG. 7, it may be preferable to vary the diameters of the respective rolls. For example, each of the rolls A and B may have a diameter of 9 inches with the rolls A rotating at a rate of from 800 to 2000 revolutions per minute and a linear speed of up to 4700 feet/minute and the rolls B rotating at a rate of from 1500 to 3500 revolutions per minute and at a linear speed of up to 9425 feet per minute. The rolls C may then have a diameter preferably from 18 inches to 30 inches with roll D having a diameter of from 24 inches to 40 inches. Finally roll E may preferably have a diameter of from 9 inches to 24 inches.

It is believed that the arrangements of FIGS. 6 and 7 will result in production rates of up to or in excess of 1600 pounds per hour with little loss in web quality. Double feeding of rolls by preceeding rolls would also tend to improve web uniformity from selvage to selvage while simultaneously providing a stronger web.

Figure 8:
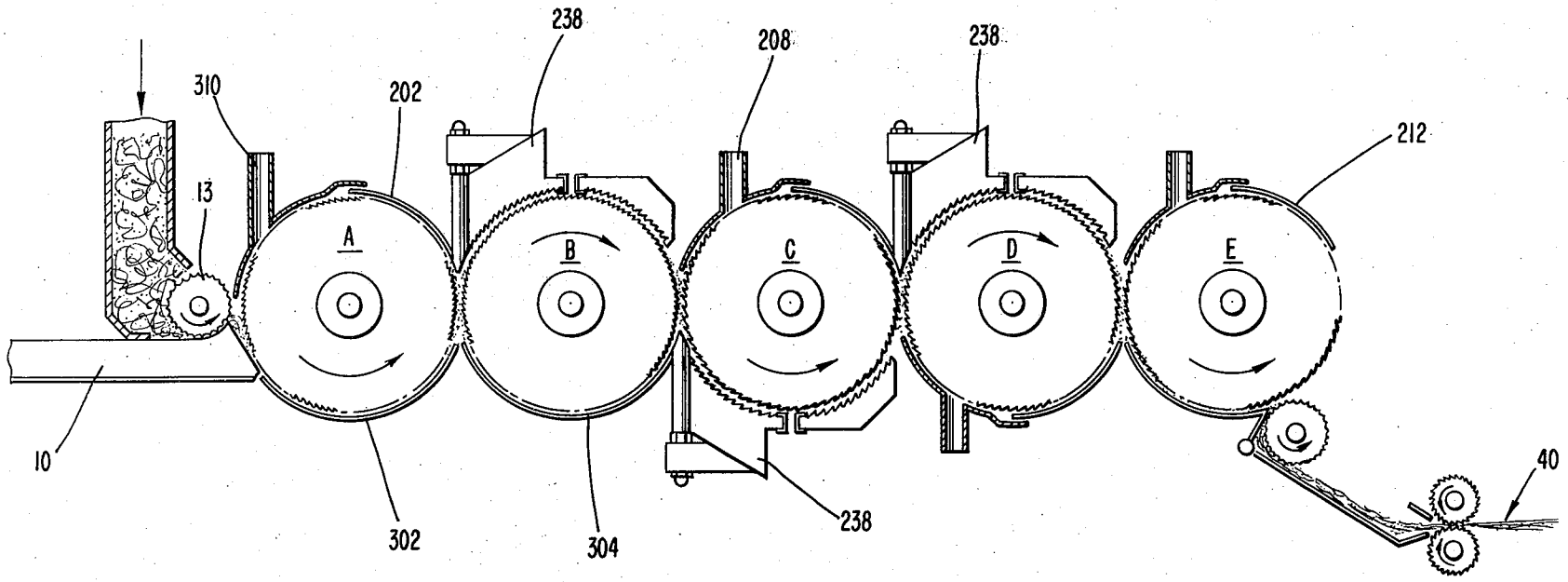
FIG. 8 is a schematic illustration of the portion of the fiber treatment unit shown in FIG. 3 having a shrouding member arrangement with solid shroud members provided for bottom portions of a first roll and a second roll.

Finally, with respect to FIG. 8, the fiber treatment unit of FIG. 3 is provided with a pair of substantially solid shroud members 302, 304 along lower portions of rolls A and B. The solid shroud members 302 or 304 may also be perforated to separate small trash particles from fibers. The fiber treatment unit may advantageously be used to reprocess waste material recovered from an original processing of fibers. Such reprocessing of waste material permits a retrieval of useful fibers which would otherwise be substantially unrecoverable.

The present invention may also be utilized to reclaim the fibrous component of highly compressed waste. Highly compressed waste is defined as having a density generally about twice that of a standard density bale (i.e. about 28 lbs/cubic foot). For example, the highly compressed waste may have a density of approximately 50 lbs/ft$^3$ versus a density of approximately 25 lbs/ft$^3$ for a standard density bale.

Reprocessing of highly compressed waste material requires that the fiber retriever 19 under roll A (see FIG. 3) be substantially closed in order to subject the material to carding action. Such carding action is necessary to open up the compressed fiber portion of the waste material so that the aero-dynamic characteristics of the fiber portion becomes significantly different from the non-cotton fiber portion of the material. Afterwards, the waste material may be processed normally and the non-fiber portion of the compressed waste will be separated from the cotton fiber portion.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

We claim:

1. A process for treating a gross mass of tangled, randomly oriented fibers, which process comprises:

(I) conveying the gross mass of fibers in a generally longitudinal travel direction to a first location at a rate of above about 400 pounds per hour while gripping the gross mass of fibers;

(II) subjecting the gripped mass of fibers to a deflection at a first location to cause leading fiber portions of mass fractions of fibers to experience a deflecting motion generally transverse to the longitudinal travel direction and simultaneously subjecting the leading fiber portions of the mass fractions to an accelerating force in the first circular direction of travel for the fibers, the force tending to accelerate the mass fractions of fibers in the first circular travel direction and to thereby increase the linear speed of the mass fractions of fibers to a linear speed of above about 2,000 feet per minute, the deflecting in the transverse direction and accelerating force in the first circular travel direction while gripping the gross mass of fibers effecting plucking of the mass fractions from the gross mass of tangled, randomly oriented, fibers and assisting in thinning and orienting the mass of fibers in the travel direction and assisting in disentangling the fibers;

(III) at a second location downstream of the first location subjecting the mass fractions of fibers traveling in a circular travel direction to a generally tangential accelerating force to thereby further increase the linear speed of the mass fractions of fibers in a second circular travel direction sinuous to the upstream circular travel direction to cause the fibers to accelerate freely in the second location, the combined effects of accelerating sinuously and carding on the first face portion tending to thin and draft apart individual fibers in the travel direction and tending to separate and disentangle individual fibers laterally of the travel direction;

(IV) at a third location downstream of the second location subjecting the mass fractions of fibers traveling in a circular travel direction to another generally tangential accelerating force to thereby still further increase the linear speed of the mass fractions of fibers in a third circular travel direction sinuous to the upstream circular travel direction to cause the fibers to accelerate freely in the third circular travel direction while at the third location carding a second face portion on a mass fractions side opposite the first face portion of the mass fractions of fibers, the combined effects of accelerating sinuously and carding on the second opposite face portion tending to thin and draft apart individual fibers in the travel direction and tending to separate and disentangle individual fibers laterally of the travel direction;

(V) subjecting the mass fractions of fibers at a subsequent location downstream of the third location to a decelerating force to thereby decrease the linear speed of the mass fractions of fibers to cause consolidating of the individual fibers and condensing of the mass fractions of fibers;

(VI) subsequent to step (II) and prior to step (V) at at least one location where the mass fractions of fibers are in a circular travel direction at a constant velocity, additionally carding the mass fractions of fibers on at least one face portion to cause a retarding effect on individual fiber portions in the carded face portion while the velocity of remaining individual fiber portions is being maintained, thereby aiding in orienting and separating individual fibers in the travel direction and separating individual fibers in the travel direction and laterally thereof and aiding in further disentangelement of individual fibers; and;

(VII) subsequent to step (V), recovering at a rate of above about 400 pounds per hour a consolidated mass of fibers.

2. A process according to claim 1 wherein the consolidated mass of fibers at (V) has a density of below about 1200 grains per square yard.

3. A process according to claim 2 wherein the gross mass of fibers conveyed to the first location is a batt of cotton fibers.

4. A process according to claim 1 wherein the gross mass of fibers conveyed to be first location is a waste material recovered from an original processing of fibers and further comprising the step of:

(VIII) at the first location shrouding the mass fractions of fibers in the first circular travel direction to prevent trash from being thrown downwardly and outwardly from the circular travel direction and also to subject the mass fractions of fibers to a carding action wherein the fibers of the waste material are substantially opened.

5. A process for treating a gross mass of tangled, randomly oriented, trash-containing fibers, which process comprises:

(I) providing the mass of fibers in a batt form of a weight of above about 2,000 grains per square yard and having longitudinal and lateral dimensions substantially greater than its dimensional thickness thereby having opposite face portions of the batt;

(II) conveying the gross mass of fibers in the batt form in a generally longitudinal travel direction to a first location at a rate of above about 400 pounds per hour per 42 inches of lateral dimension while gripping the gross mass of fibers to maintain the gross mass of fibers substantially stationary in a direction substantially transverse to the longitudinal travel direction;

(III) subjecting the gripped mass of fibers to an abrupt deflection at the first location to cause leading fiber portions of mass fractions of fibers to experience a deflecting motion generally transverse to the longitudinal travel direction and simultaneously subjecting the leading fiber portions of the mass fractions to a sudden acceleration force in a first circular direction of travel for the fibers, the force tending to accelerate the mass fractions of fibers in the circular travel direction to a speed of above about 2,000 feet per minute, the deflecting in the transverse direction and accelerating force in the circular travel direction while gripping the gross mass of fibers effecting plucking of the mass fractions from the gross mass of tangled, randomly oriented, fibers and assisting in thinning and orienting the mass of fibers in the travel direction and assisting in disentangling the mass of fibers, and the deflecting and accelerating also causing trash to be freed and separated from the mass fractions of fibers;

(IV) at a second location downstream of the first location subjecting the mass fractions of fibers traveling in a circular travel direction to a generally tangential accelerating force in a second circular travel direction to cause the fibers to accelerate freely in the second circular travel direction while carding a first face portion of the mass fractions of fibers at the second location, the combined effects of accelerating sinuously and carding on the first face portion tending to thin and draft apart individual fibers in the travel direction and tending to separate and disentangle individual fibers laterally of the travel direction and aiding in loosening of trash from fibers;

(V) at a third location downstream of the second location subjecting the mass fractions of fibers traveling in a circular travel direction to another generally tangential accelerating force in a third circular travel direction sinuous to the upstream circular travel direction to cause the fibers to accelerate freely in the third circular travel direction while at the third location carding a second face portion on a mass fractions side opposite the first face portion of the mass fractions of fibers, the combined effects of accelerating sinuously and carding on the second opposite face portion tending to thin and draft apart individual fibers in the travel direction and tending to separate and disentangle individual fibers laterally of the travel direction and aiding in further loosening of trash from fibers;

(VI) subjecting the mass fractions of fibers at a subsequent location downstream of the third location to a decelerating force to cause consolidating of the individual fibers and condensing of the mass fractions of fibers;

(VII) subsequent to step (III) and prior to step (VI), at at least two locations where the mass fractions of fibers are in a circular travel direction at a constant velocity, additionally carding the mass fractions of fibers on at least one face portion thereof to cause a retarding effect on individual fibers portions in the at least one carded face portion while the velocity of remaining individual fibers portions is being maintained, thereby aiding in orienting and separating individual fibers in the travel direction and laterally thereof and aiding in further disentanglement and loosening of trash from individual fibers;

(VIII) subsequent to step (III) and prior to step (VI), at at least one location where the mass fractions of fibers are in a circular travel direction at a constant velocity, carding the mass fractions of fibers on a face portion of the batt opposite the at least one face portion carded in step (VII) to cause a retarding effect on individual fiber portions in the carded face portion while the velocity of remaining fibers portions in the batt is being maintained, thereby aiding in orienting and separating individual fibers in the travel direction and laterally thereof and aiding further disentanglement and loosening of trash from individual fibers;

(IX) conveying loosened and freed trash away from the mass of fibers; and (X) subsequent to step (VI), recovering a consolidate, substantially trash-free mass of fibers having a substantial portion of individual fibers therein.

6. A process according to claim 5 wherein the gross mass of fibers conveyed to the first location is a waste material recovered from an original processing of fibers and further comprising the step of:

(XI) at the first location shrouding the mass fractions of fibers in the first circular travel direction to prevent the trash freed and separated from the mass fractions of fibers from being thrown downwardly and outwardly from the circular travel direction and also to subject the mass fractions of fibers to a carding action wherein the fibers of the waste material are substantially opened.

7. A high capacity, high speed process for treating a mass of tangled, randomly oriented, trash-containing cotton fibers, which process comprises:

(I) providing the mass of fibers in a thick batt form of a weight between about 2,000 to about 20,000 grains per square yard and having longitudinal and lateral dimensions substantially greater than its dimensional thickness thereby having opposite face portions of the batt;

(II) conveying the mass of fibers in the batt form from a feed roll in a generally longitudinal travel direction to a first location at a rate of above about 400 pounds per hour while gripping the mass of fibers to maintain the gross mass of fibers substantially stationary in a direction transverse to the longitudinal travel direction;

(III) at the first location, directing, against the mass of fibers in a direction generally traverse to the longitudinal travel direction, teeth on a cylindrical surface of a first rotating cylinder, the teeth having forward faces inclined at substantial angles in the direction of rotation of the cylinder to cause leading fiber portions of mass fractions of fibers to experience a deflecting motion generally transverse to the longitudinal travel direction and simultaneously to subject leading fiber portions of the mass fractions to a sudden accelerating force in a first circular direction of travel for the fibers, the force tending to accelerate the mass fractions of fibers in the circular travel direction to a speed above about 2,000 feet per minute, the deflecting in the transverse direction and accelerating force in the circular travel direction while gripping the gross mass of fibers effecting plucking of the mass fractions from the gross mass of tangled, randomly oriented, fibers and assisting in thinning and orienting the mass of fibers in the travel direction and assisting in disentangling the fibers, and the deflecting and accelerating also causing trash to be thrown downwardly and outwardly from the circular travel direction and be freed and separated from the mass fractions of fibers;

(IV) at a second location downstream of the first location directing the mass fractions of fibers traveling in a circular travel direction tangentially against teeth on cylindrical surfaces of a second rotating cylinder, the second cylinder rotating in a direction opposite the first cylinder and having teeth with forward faces inclined at a substantial angle in the direction of rotation of the second cylinder, to cause a generally tangential accelerating force applied by the teeth of the second cylinder to the fibers in a second circular travel direction sinuous to the upstream circular travel direction to cause mass fractions of the fibers to accelerate freely in the second circular travel direction from the teeth of the first cylinder while carding a first face portion of the mass fractions of fibers at the second location, the combined effects of accelerating sinuously and carding on the first face portion tending to thin and draft apart individual fibers in the travel direction and tending to separate and disentangle individual fibers laterally of the travel direction and aiding in loosening of trash from fibers;

(V) at a third location downstream of the second location directing the mass fractions of fibers traveling in a circular travel direction tangentially against teeth on cylindrical surfaces of a third rotating cylinder, the third cylinder rotating in a direction opposite the second cylinder and having teeth with forward faces inclined at a substantial angle in the direction of rotation of the third cylinder, to cause a generally tangentially accelerating force applied by the teeth of the third cylinder to the fibers in a third circular travel direction sinuous to the upstream circular travel direction to cause the fibers to accelerate freely in the third circular travel direction from the teeth of the second cylinder while carding a second opposite face portion of the mass fractions of fibers at the third location, the combined effects of accelerating sinuously and carding on the second face portion tending to thin and draft apart individual fibers in the travel direction and tending to separate and disentangle individual fibers laterally of the travel direction and aiding in loosening of trash from the fibers;

(VI) subjecting the mass fractions of fibers at a subsequent location downstream of the third location to a decelerating force prior to step (X) to cause consolidating of the individual fibers and condensing of the mass fractions of fibers;

(VII) subsequent to step (III) and prior to step (VI), at at least two locations where the mass fractions of fibers are in a circular travel direction at a constant velocity, additionally carding the mass fractions of fibers on face portions thereof to cause a retarding effect on individual fiber portions in the carded face portions while the velocity of remaining individual fiber portions is being maintained, thereby aiding in orienting and separating individual fibers in the travel direction and laterally thereof and aiding in further disentanglement and loosening of trash from individual fibers;

(VIII) subsequent to step (III) and prior to step (VI), at at least one location where the mass fractions of fibers are in a circular travel direction at a constant velocity, carding the mass fractions of fibers on a face portion of the batt opposite the face portion carded in step (VII) to cause a retarding effect on individual fiber portions in the carded face portion while the velocity of remaining fiber portions in the batt is being maintained, thereby aiding in orienting and separating individual fibers in the travel direction and laterally thereof and aiding further disentanglement and loosening of trash from individual fibers; (IX) conveying loosened and freed trash away from the mass of fibers; and (X) subsequent to step (VI), recovering at a rate of above about 400 pounds per hour a consolidated, substantially trash-free and substantially nep-free mass of fibers.

8. Apparatus for simultaneously cleaning and carding a body of fibers comprising:

(a) a train of at least three rolls adjacently mounted for rotation about parallel axes;

(b) a plurality of fiber-grabbing teeth secured to the surface of each of said rolls of said train, said teeth all having forward faces inclined at a substantial angle in the direction of rotation of the respective rolls to which they are secured, said rolls being spatially disposed to bring the teeth in the nip of adjacent rolls into carding and fiber-transferring relation;

(c) means for rotating said rolls of said train such that adjacent rolls rotate in opposite directions, the peripheral speed of each successive roll being greater than the peripheral speed of a preceding roll whereby a body of fibers introduced onto the teeth of the first of said rolls will advance in a sinuous path along the peripheries of successive rolls to the last of said rolls as a progressively attenuated web of carded fibers, the peripheral speeds of said rolls being sufficient to cause trash and debris carried by the body of fibers to be loosened in said body;

(d) at least one additional carding means disposed adjacent the peripheries of at least one roll in the train to provide an additional carding of the body of fibers;

(e) means for doffing the cleaned and carded fiber from the last of the rolls in the train; and (f) a plurality of means for shrouding some rolls disposed adjacent the peripheries of some rolls and opposite the at least one additional carding means.

9. Apparatus in accordance with claim 8 wherein the additional carding means includes at least two stationary, cylindrically-contoured, teeth-bearing carding plates mounted in juxtaposition to at least two rolls in a carding relation to the teeth on said rolls, the teeth on said stationary plates being inclined at a substantial angle opposite to the direction of rotation and inclination of the teeth on the respective juxtaposed rolls, and adjacent corresponding sectors of the peripheries of alternate rolls, thereby to subject one side of the web to an additional carding action, said plates being of insufficient width to extend along said sectors into the nip of adjacent rolls.

10. Apparatus in accordance with claim 8 wherein the additional carding means includes at least two stationary carding plates which are mounted in a juxtaposed carding relation adjacent diametrically opposite sectors of adjacent rolls to subject both sides of the web to an additional carding action, said additional plates being of insufficient width to extend along said sector into the nip of adjacent rolls.

11. Apparatus in accordance with claim 8 wherein the additional carding means includes at least three stationary carding plates each mounted adjacent corresponding sectors of respective peripheries of two alternate rolls and adjacent a diametrically opposite sector of an intervening roll.

12. Apparatus according to claim 8 wherein the means (e) includes a cylinder roll perforated to allow air suction to assist in subjecting the mass fractions of fibers to a decelerating force and a consolidating and condensing and also to allow for removal of dust and fine trash.

13. Apparatus according to claim 8 further comprising:

air withdrawal means for removing air and particulate trash from the nips of some adjacent rolls, the air withdrawal means having a swirling air current to assist in removing the particulate trash.

14. The apparatus of claim 8 wherein the plurality of means for shrouding some rolls includes a first substantially solid shroud member provided along a lower portion of the first of said rolls.

15. Apparatus for simultaneously cleaning and carding a body of fibers comprising:

(a) a train of rolls adjacently mounted for rotation about parallel axes, said train of rolls comprising first to fourth cylinder members, a feed roll member for supplying fibers to said first cylinder member, doffing means for removing carded fibers from the fourth cylinder member, and, means for rotating said feed roll member and first to fourth cylinder members such that adjacent cylinder members rotate in opposite directions, the peripheral speed of each successive cylinder member being greater than the peripheral speed of a preceding cylinder member;

(b) a plurality of fiber-grabbing teeth secured to the surface of said first to fourth cylinder members said teeth all having forward faces included at a substantial angle in the direction of rotation of the respective members to which they are secured, said members being spatially disposed to bring the teeth in the nip of adjacent members into carding and fiber-transferring relation, the directions and speeds of rotation of the respective members causing a body of fibers introduced onto the teeth of said first cylinder member to advance in a sinuous path along the peripheries of said members to said fourth cylinder member as a progressively attenuated web of carded fibers, thereby exposing opposite sides of a web to successive cylinder members, the peripheral speeds of said members being sufficient to cause trash and debris carried by the body of fibers to be loosened in said body;

(c) additional carding means disposed adjacent corresponding sectors of at least two of said cylinder members to provide additional carding points;

(d) means adjacent said cylinder members to control air currents along the surfaces thereof to prevent blow-back of fibers to a preceding cylinder member;

(e) first through fourth shrouds closely adjacent to said first to fourth cylinder members respectively and disposed oppositely with respect to the additional carding means of the at least two cylinder members.

16. Apparatus according to claim 15, wherein: the doffing means includes a fifth cylinder member disposed after said fourth cylinder member, the fifth cylinder member rotating at a peripheral speed slower than the peripheral speed of the fourth cylinder member to cause a condensing of the body of fibers.

17. Apparatus according to claim 15 wherein the doffing means includes a fifth cylinder member perforated to allow air suction to assist in subjecting the mass fractions of fibers to a decelerating force and to a consolidation and condensing and also to allow for removal of dust and fine trash.

18. Apparatus according to claim 15, further comprising:

air withdrawal means for removing air and particulate trash from the nip of some adjacent rolls, the air withdrawal means having a swirling air flow to assist in removing the particulate trash.

19. The apparatus of claim 15 wherein the first shroud is substantially solid and is provided along a lower portion of the first cylinder member.

20. Apparatus for simultaneously cleaning and carding a body of fibers comprising:

(a) a train of a plurality of rolls adjacently mounted for rotation about parallel axes said train including a plurality of first rolls;

(b) a plurality of fiber-grabbing teeth secured to the surface of each of said rolls of said train, said teeth all having forward faces included at a substantial angle in the direction of rotation of the respective rolls to which they are secured, said rolls being spatially disposed to bring the teeth in the nip of adjacent rolls into carding and fiber-transferring relation;

(c) means for rotating said rolls of said train such that adjacent rolls rotate in opposite directions, the peripheral speed of each successive roll being greater than the peripheral speed of a preceding roll with a plurality of portions of the body of fibers each introduced onto the teeth of each of the plurality of first rolls advancing and combining with one another on successive rolls until all of the portions of the body of fibers become a single body of fibers which have been conveyed in a multi-sinuous path along the peripheries of the successive rolls to the last of said rolls as a progressively attenuated web of carded fibers, the peripheral speeds of said rolls being sufficient to cause trash and debris carried by the plurality of portions of the body of fibers to be loosened in said body;

(d) a plurality of additional carding means disposed adjacent the peripheries of some rolls in the train to provide additional carding points;

(e) means for doffing the cleaned and carded web from the last of the rolls in the train, and from the body of fibers;

(f) a plurality of means disposed adjacent the peripheries of some rolls opposite the plurality of additional carding means for shrouding some rolls.

21. Apparatus according to claim 20 wherein the plurality of first rolls includes eight first rolls.

22. Apparatus according to claim 20, wherein the plurality of first rolls includes two first rolls.

23. The apparatus of claim 22 wherein the plurality of means disposed adjacent the peripheries of some rolls opposite the plurality of additional carding means for shrouding some rolls include at least one first substantially solid shroud member provided along a lower portion of one of said plurality of first rolls.

* * * * *

UNITED STATES PATENT AND TRADEMARK OFFICE

CERTIFICATE OF CORRECTION

PATENT NO. : 4,219,908
DATED : September 2, 1980
INVENTOR(S) : Allen R. Winch

It is certified that error appears in the above-identified patent and that said Letters Patent are hereby corrected as shown below:

Column 1, line 21, delete "fabrics of sliver" and insert therefor --fabrics or sliver--.
Column 2, line 36, after "years" delete the comma.
Column 3, line 16, delete "were" and insert therefor --was--;
line 54, delete "naps" and insert therefor --neps--;
line 63, delete "throughout" and insert therefor --throughput--.
Column 7, line 44, delete "characteritics" and insert therefor --characteristics--;
line 56, delete "Control" and insert therefor --Controls--.
Column 9, line 34, delete "or" and insert therefor --of--.
Column 12, line 18, delete the numeral "90".
Column 13, line 25, delete "carding" and insert therefor --carded--.
Column 17, TABLE V, delete "$\alpha$ = S/0.75 II" and insert therefor --$\alpha$ = S/0.75 $\Pi$--.
Column 23, line 34, delete "be" and insert therefor --the--.
Column 25, line 9, delete "consolidate" and insert therefor --consolidated--.

Signed and Sealed this

Sixteenth Day of December 1980

[SEAL]

Attest:

SIDNEY A. DIAMOND

Attesting Officer

Commissioner of Patents and Trademarks